US012378765B2

(12) United States Patent
Watson et al.

(10) Patent No.: US 12,378,765 B2
(45) Date of Patent: Aug. 5, 2025

(54) CEILING SYSTEM

(71) Applicant: ARMSTRONG WORLD INDUSTRIES, INC., Lancaster, PA (US)

(72) Inventors: Stephanie J. Watson, Coatesville, PA (US); Anouk Lacoste, Laval (CA); Denis Maltais, Laval (CA)

(73) Assignee: AWI Licensing LLC, Wilmington, DE (US)

( * ) Notice: Subject to any disclaimer, the term of this patent is extended or adjusted under 35 U.S.C. 154(b) by 231 days.

(21) Appl. No.: 18/212,353

(22) Filed: Jun. 21, 2023

(65) Prior Publication Data

US 2023/0407634 A1 Dec. 21, 2023

Related U.S. Application Data

(60) Provisional application No. 63/353,928, filed on Jun. 21, 2022.

(51) Int. Cl.

| | |
|---|---|
| ***E04B 9/22*** | (2006.01) |
| ***E04B 9/04*** | (2006.01) |
| ***E04B 9/06*** | (2006.01) |

(52) U.S. Cl.
CPC ..... *E04B 9/225* (2013.01); *E04B 9/04* (2013.01); *E04B 9/067* (2013.01)

(58) Field of Classification Search
CPC ..... E04B 9/225; E04B 9/04; E04B 9/067
See application file for complete search history.

(56) References Cited

U.S. PATENT DOCUMENTS

| | | | | |
|---|---|---|---|---|
| 4,245,446 | A | 1/1981 | Judkins | |
| 4,438,613 | A | 3/1984 | Hintsa | |
| 4,580,387 | A | 4/1986 | Rogers | |
| 4,873,809 | A | 10/1989 | Paul | |
| 5,428,930 | A | 7/1995 | Bagley | |
| 6,971,210 | B2 | 12/2005 | Kliegle | |
| 9,194,123 | B2 | 11/2015 | Holdridge | |
| 9,228,347 | B2 * | 1/2016 | Underkofler | E04B 9/068 |
| 9,879,424 | B1 * | 1/2018 | Underkofler | E04B 9/068 |
| 10,359,163 | B1 | 7/2019 | Hettwer | |
| 11,486,141 | B2 * | 11/2022 | Baxter | E04B 9/065 |

(Continued)

OTHER PUBLICATIONS

USG Ceilings' Barz®—Open Plenum Modular Acoustic Baffles Product Sheet, 2023.

*Primary Examiner* — Rodney Mintz
(74) *Attorney, Agent, or Firm* — Patrick Sheldrake

(57) ABSTRACT

A ceiling system including a support grid and a panel assembly. The panel assembly includes backslats that are arranged parallel to one another, panels that are coupled to the backslats, and mounting assemblies for mounting the panel assembly to the support grid. The mounting assemblies include a mounting bracket and a torsion spring. A first pair of the mounting assemblies is coupled to a first one of the backslats and a second pair of the mounting assemblies is coupled to a second one of the backslats. The panel assembly may be mounted to the support grid via the torsion springs of the first pair of the mounting assemblies engaging a first one of the first grid beams of the support grid and the torsion springs of the second pair of the mounting assemblies engaging a second one of the first grid beams of the support grid.

20 Claims, 18 Drawing Sheets

(56) References Cited

U.S. PATENT DOCUMENTS

| | | | | |
|---|---|---|---|---|
| 11,946,249 | B2 * | 4/2024 | Baxter | E04B 9/0478 |
| 2004/0118068 | A1 | 6/2004 | Kliegle et al. | |
| 2007/0193131 | A1 | 8/2007 | Ortiz | |
| 2015/0308112 | A1 | 10/2015 | Holdridge | |
| 2015/0345139 | A1 * | 12/2015 | Underkofler | E04B 9/26<br>52/506.08 |
| 2021/0301525 | A1 * | 9/2021 | Baxter | E04B 9/06 |
| 2023/0025771 | A1 * | 1/2023 | Baxter | E04B 9/065 |
| 2023/0313528 | A1 * | 10/2023 | Pfeifer | E04B 9/225<br>52/506.06 |

* cited by examiner

CEILING SYSTEM

CROSS-REFERENCE TO RELATED APPLICATIONS

The present application claims priority to U.S. Provisional Patent Application Ser. No. 63/353,928, filed Jun. 21, 2022, the entirety of which is incorporated herein by reference.

FIELD

The present invention relates to suspended ceiling systems, and more specifically to ceiling systems including panels that are mounted vertically or horizontally and are coupled to a support grid which is hung from a support structure of a building.

BACKGROUND

Numerous types of suspended ceiling systems and methods for mounting ceiling panels thereof have been used. One type of ceiling panel is made from metal planks that are mounted either horizontally or vertically. Such ceiling panels are mounted to a support grid to form the ceiling system that is viewed by the observer in the room below. Ceiling systems of this type may include narrow gaps between each plank, which requires progressive installation and custom access panels to be made on-site for periodic access to the plenum space between the ceiling panels and the structural support of the building. These tasks increase the time to complete installation and affect the aesthetic of the ceiling system. Thus, a need exists for a ceiling system that addresses the aforementioned deficiencies.

SUMMARY

The invention may be directed to a ceiling system that includes a support grid and a panel assembly. The panel assembly includes backslats that are arranged parallel to one another, panels that are coupled to the backslats, and mounting assemblies for mounting the panel assembly to the support grid. The mounting assemblies include a mounting bracket and a torsion spring. A first pair of the mounting assemblies is coupled to a first one of the backslats and a second pair of the mounting assemblies is coupled to a second one of the backslats. The panel assembly may be mounted to the support grid via the torsion springs of the first pair of the mounting assemblies engaging a first one of the first grid beams of the support grid and the torsion springs of the second pair of the mounting assemblies engaging a second one of the first grid beams of the support grid In one aspect, the invention may be a ceiling system comprising: a support grid comprising a plurality of first grid beams arranged substantially parallel to one another; a panel assembly comprising: first and second backslats arranged substantially parallel to one another, each of the first and second backslats extending along a backslat axis; a plurality of panels arranged substantially parallel to one another, each of the panels extending along a panel axis from a first end to a second end, and each of the panels coupled to each of the first and second backslats; a plurality of mounting assemblies, each of the mounting assemblies comprising a mounting bracket and a torsion spring operably coupled to the mounting bracket; a first pair of the mounting assemblies coupled to the first backslat; and a second pair of the mounting assemblies coupled to the second backslat; the panel assembly mounted to the support grid via the torsion springs of the first pair of the mounting assemblies engaging a first one of the first grid beams of the support grid and the torsion springs of the second pair of the mounting assemblies engaging a second one of the first grid beams of the support grid.

In another aspect, the invention may be a ceiling system comprising: a support grid comprising a plurality of first grid beams arranged substantially parallel to one another; a panel assembly comprising: first and second backslats arranged substantially parallel to one another, each of the first and second backslats extending along a backslat axis and comprising a floor plate comprising a series of pre-formed apertures, the pre-formed apertures evenly spaced from one another along the length of the first and second backslats; and a plurality of panels arranged substantially parallel to one another, each of the panels extending along a panel axis from a first end to a second end, and each of the panels coupled to each of the first and second backslats by fasteners extending through selected ones of the pre-formed apertures; the panel assembly mounted to the support grid by coupling the first backslat to a first one of the first grid beams of the support grid and coupling the second backslat to a second one of the first grid beams of the support grid.

In yet another aspect, the invention may be a ceiling system comprising: a support grid comprising a plurality of first grid beams arranged substantially parallel to one another; a panel assembly comprising: first and second backslats arranged substantially parallel to one another, each of the first and second backslats extending along a backslat axis; a plurality of panels arranged substantially parallel to one another, each of the panels extending along a panel axis from a first end to a second end, and each of the panels coupled to each of the first and second backslats; a plurality of mounting brackets configured to engage the first grid beams; a first pair of the mounting brackets coupled to the first backslat; and a second pair of the mounting rackets coupled to the second backslat; the panel assembly mounted to the support grid via the first pair of the mounting brackets engaging a first one of the first grid beams of the support grid and the second pair of the mounting brackets engaging a second one of the first grid beams of the support grid.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments of the present invention will be described with reference to the following drawings, where like elements are labeled similarly, and in which.

Figure 1:
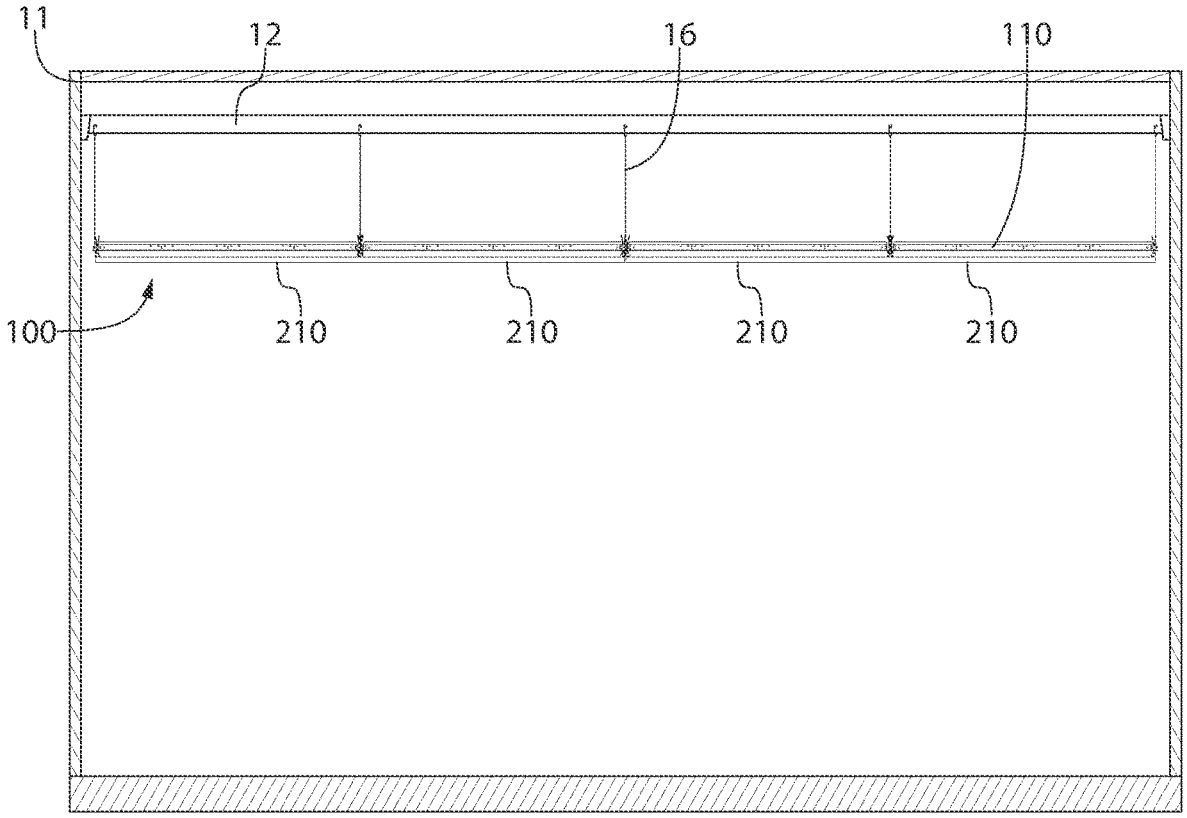
FIG. 1 is an elevation view of an exemplary building ceiling system according to an embodiment of the present invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Any ranges disclosed herein are used as shorthand for describing each and every value that is within the range. Any value within the range can be selected as the terminus of the range.

Figure 18:
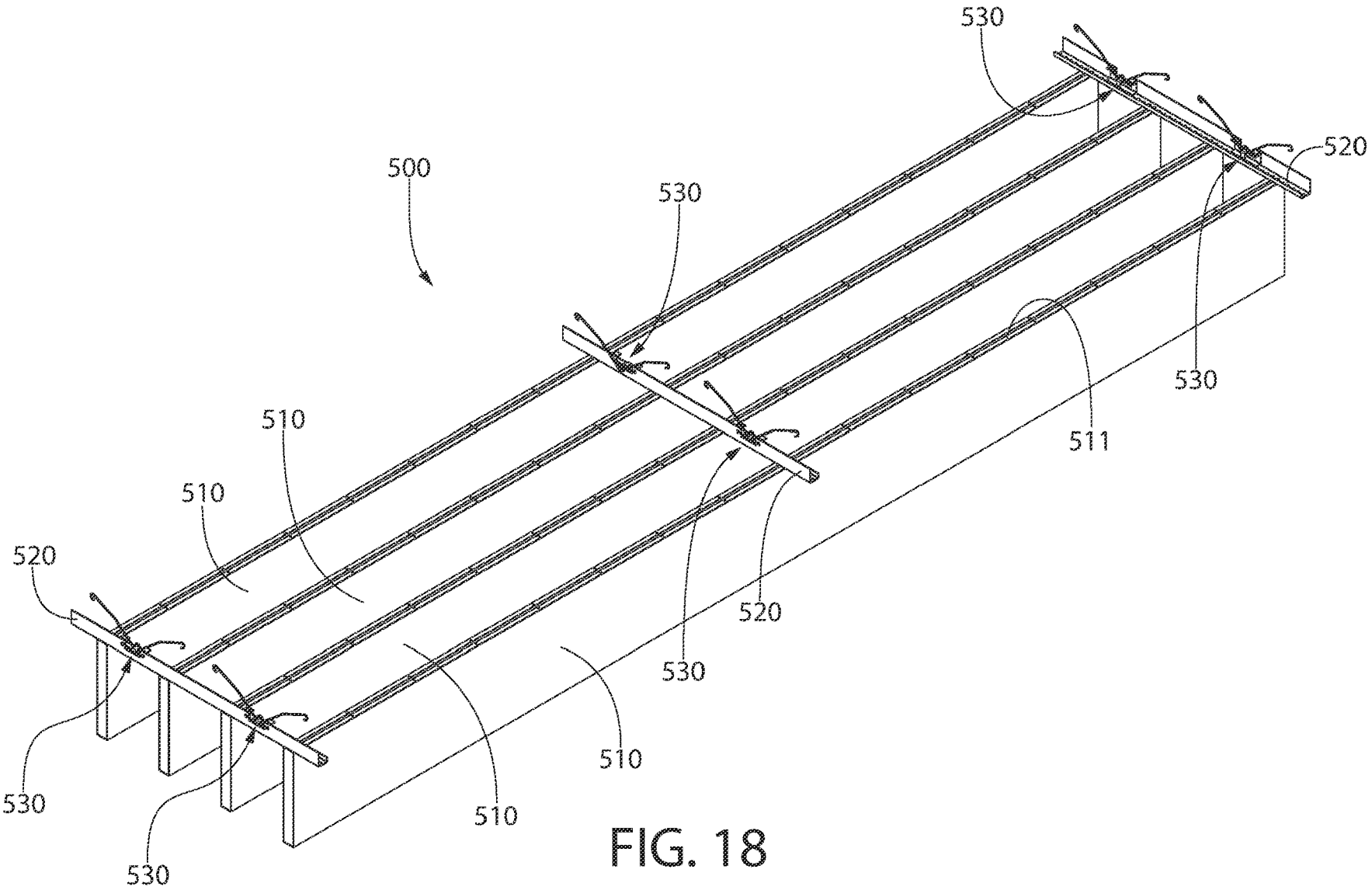
FIG. 18 is a top perspective view of a ceiling system in accordance with another embodiment of the present invention.

Referring first to FIG. 1, an exemplary building 11 having a ceiling system 100 therein is illustrated. The ceiling system 100 may be supported by a building support structure 12. The ceiling system 100 may be what is known as a suspended ceiling, in that it is suspended below the overhead support structure of the building 11. The building support structure 12 may be a part of a ceiling or roof structure and may be coupled to the load bearing walls of the building 11, either directly or indirectly. The ceiling system 100 may comprise a support grid 110 that may be coupled to the building support structure 12. The support grid 110 may be suspended via a plurality of hangers 16. The plurality of hangers 16 may be cables, chains, wires, ropes. Alternatively, the support grid 110 may be mounted directly to the building support structure 12. A plurality of panels 210 may be coupled to the support grid 110 either individually or as part of a panel assembly which includes several of the panels 210. The panels 210 may form the portion of the ceiling system 100 which is visible to a user. The panels 100 may be oriented horizontally as shown in FIG. 1, or vertically such as is shown in FIG. 18.

Figure 2:
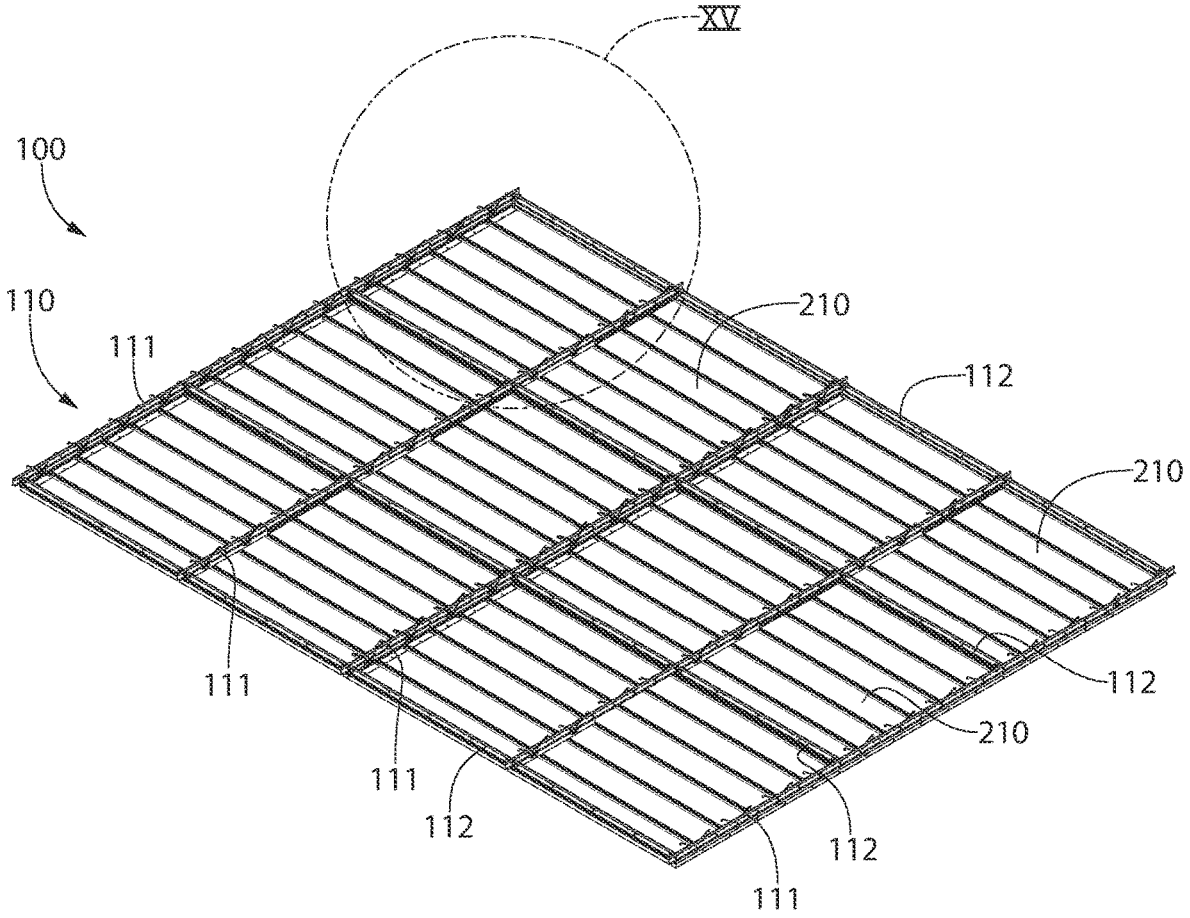
FIG. 2 is a perspective view of a ceiling system in accordance with an embodiment of the present invention.
Figure 3:
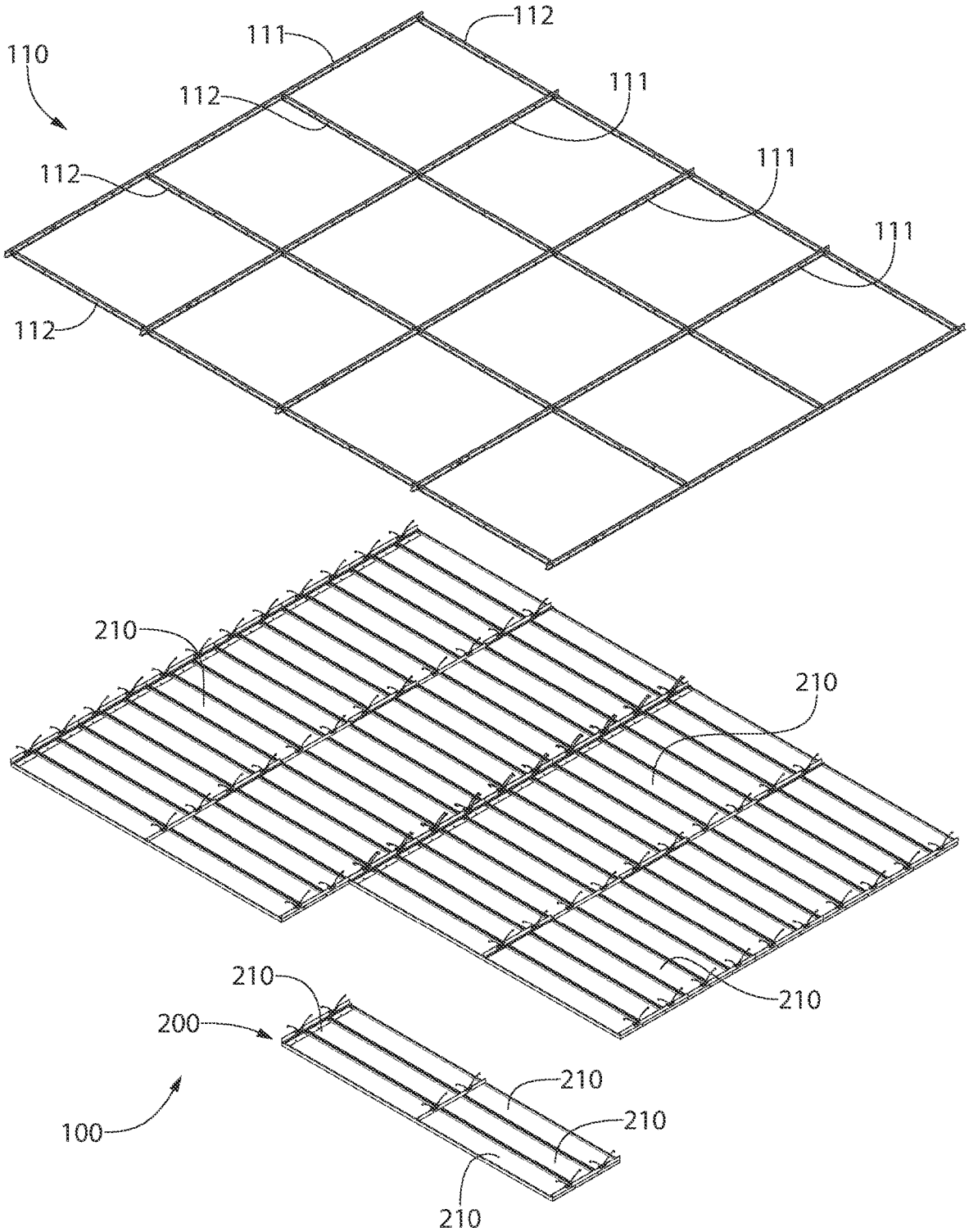
FIG. 3 is an exploded perspective view of the ceiling system of FIG. 2 depicting a support grid and a plurality of panel assemblies, with one of the panel assemblies exploded from the rest.

Referring to FIGS. 2 and 3, the ceiling system 100 will be further described. The support grid 110 may comprise a plurality of first grid beams 111 that are arranged substantially parallel to one another. The support grid 110 may also comprise a plurality of second grid beams 112 that are arranged substantially parallel to one another. The plurality of second grid beams 112 may be oriented perpendicular to the plurality of first grid beams 111. In other embodiments, the plurality of second grid beams 112 may be oriented at a non-perpendicular angle relative to the first grid beams 111. In still other embodiments, the second grid beams 112 may be omitted. The plurality of first and/or second grid beams 111, 112 may be hung or suspended from the building support structure 12 as shown in FIG. 1. The plurality of first and second grid beams 111, 112 may collectively define square or rectangular shaped openings within which the panels 210 are located, although the invention is not to be so limited in all embodiments and other shaped openings may be formed in other embodiments depending on the orientation of the second grid beams 112 relative to the first grid beams 111. The panels 210 may extend over or across the support grid 110 so that the support grid 110 is not visible to a person standing below the ceiling system 100 within a building or room. That is, the panels 210 may hide the support grid 110 from view to a person standing below the ceiling system 100.

The ceiling system 100 may comprise at least one panel assembly 200 that comprises a plurality of the panels 210. The ceiling system 100 may more specifically comprise a plurality of the panel assemblies 200, each of which is configured to be mounted to the support grid 110. In the exemplified embodiment, there are three of the panels 210 in each panel assembly 200, and the ceiling system 100 comprises twelve of the panel assemblies 200 (for a total of thirty-six panels). However the invention is not to be so limited in all embodiments and each panel assembly 200 may comprise less than three of the panels 210 or more than three of the panels 210 as may be desired for purposes of ease of manufacturability and installation. Furthermore, the exact number of panel assemblies 200 included in a particular ceiling system 100 may be dictated, at least in part, by the size of the space within which the ceiling system 100 is mounted and the desired aesthetic.

Figure 4:
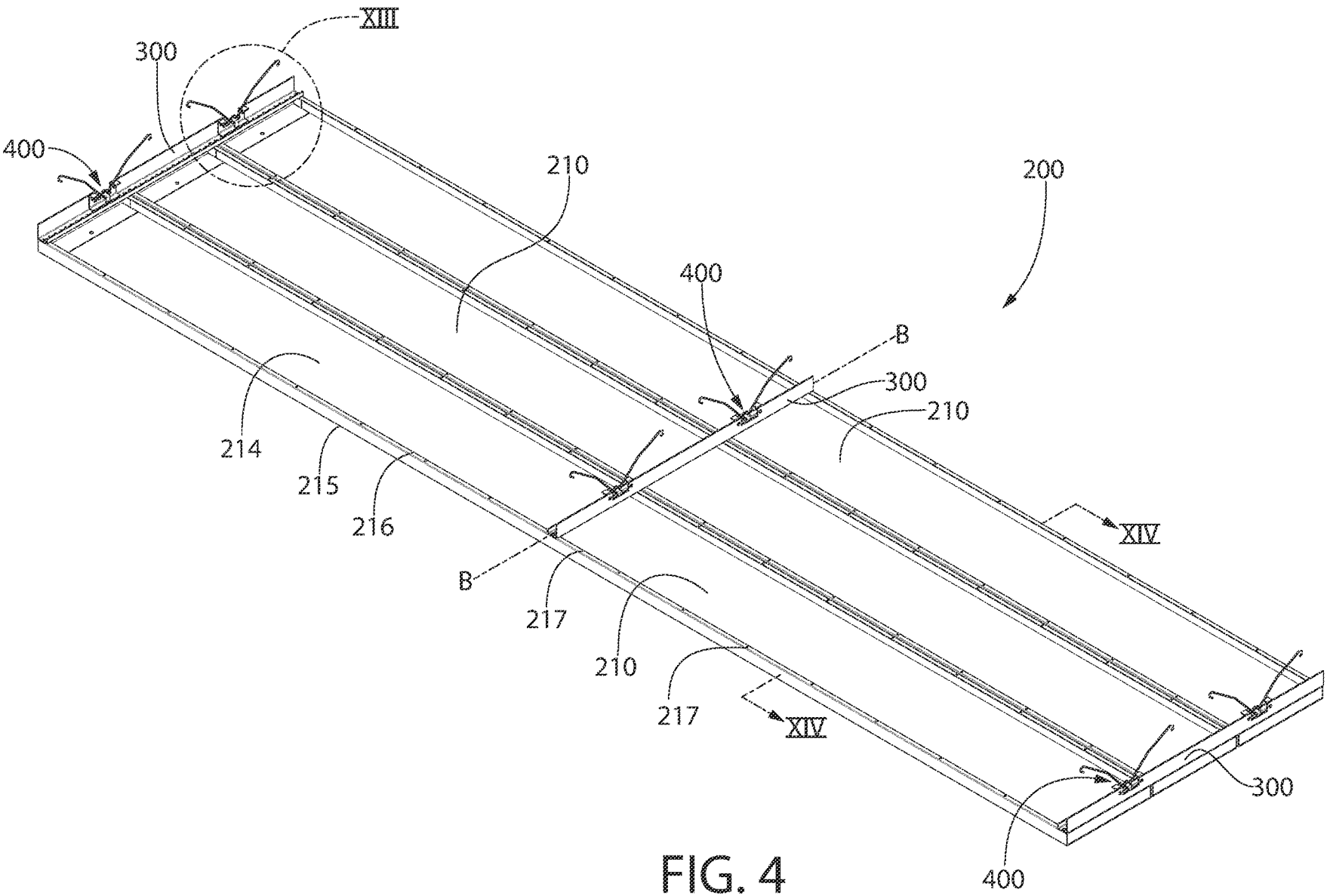
FIG. 4 is a perspective view of one of the panel assemblies of the ceiling system of FIG. 2.
Figure 5:
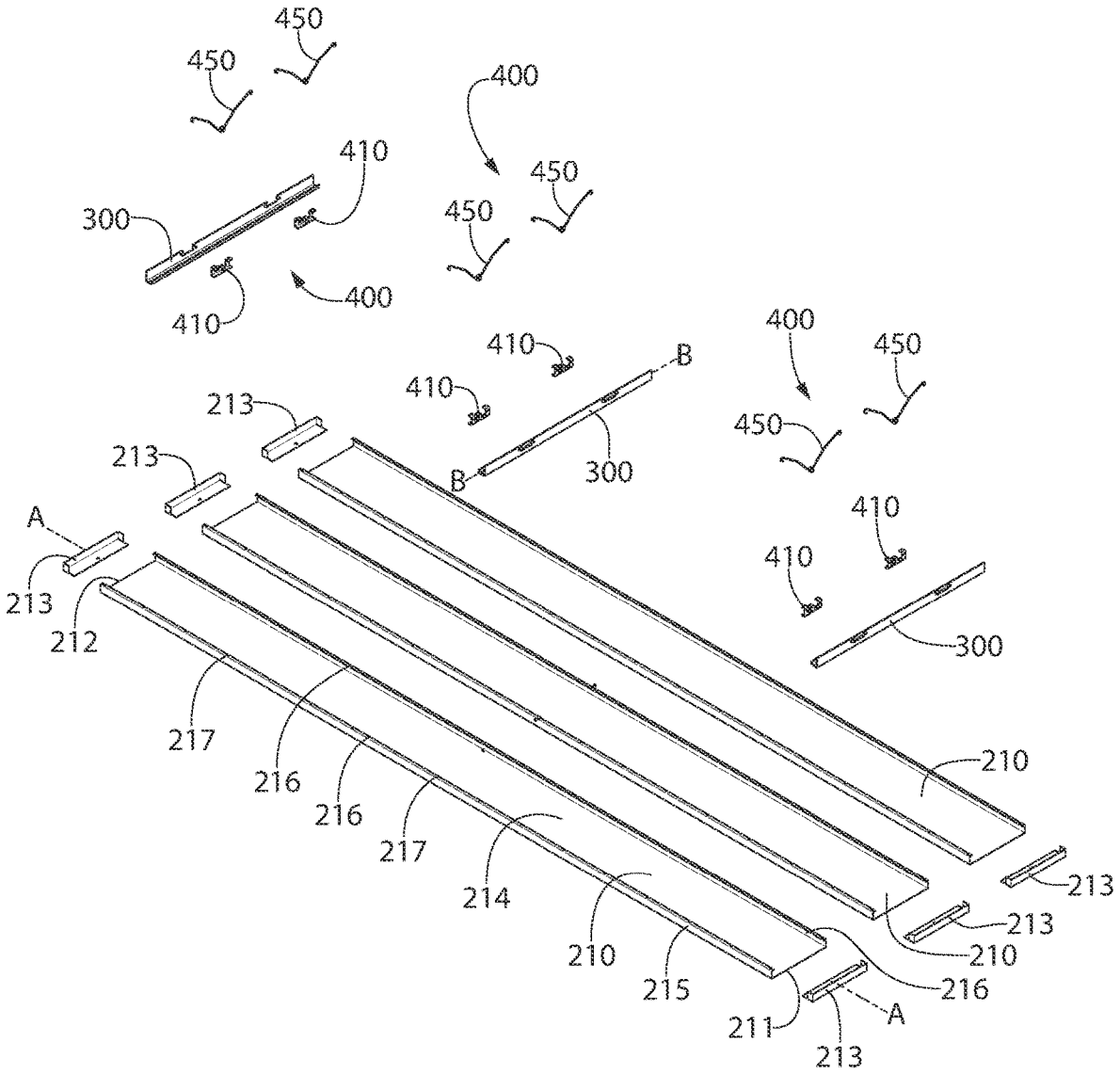
FIG. 5 is an exploded view of the panel assembly of FIG. 4.

Referring to FIGS. 4 and 5 concurrently, one of the panel assemblies 200 is illustrated assembled (FIG. 4) and exploded or disassembled (FIG. 5). As noted above, the panel assembly 200 comprises three of the panels 210 that are coupled together as described further below to form the panel assembly 200, although more or fewer than three of the panels 210 may form each of the panel assemblies 200 in other embodiments. The panel assembly 200 generally comprises a plurality of the panels 210 (which could be three as shown or more/less than three), a plurality of backslats 300 that are coupled to each of the panels 210 of the panel assembly 200, and a plurality of mounting assemblies 400. In the exemplified embodiment, there are three of the backslats 300, and each backslat 300 is coupled to each of the panels 210 in the panel assembly 200. However, in some embodiments there may be only two of the backslats 300 or there may be more than three of the backslats 300 in the panel assembly 200. The number of panels 210 in the panel assembly 200 as well as the width and/or length of the panels 210 in the panel assembly 200 may dictate the number of backslats 300 needed in the panel assembly 200. The backslats 300 are coupled to each of the panels 210 in the panel assembly 200 to lock all of the panels 210 of the panel assembly 200 together to form a single unit that is collectively coupled to and detached from the support grid 110. Thus, each panel 210 need not be separately coupled to the support grid 110, but instead the panel assembly 200 which comprises a plurality of the panels 210 is coupled to the support grid 110 as a single unitary structure.

Each of the panels 210 comprises a first end 211, a second end 212, and a panel axis A-A extending from the first end 211 to the second end 212. Each of the panels 210 of the panel assembly 200 is arranged parallel to each of the other panels 210 of the panel assembly 200 such that the panel axes A-A of each panel 210 are parallel to one another. The panels 210 may comprise end caps 213 coupled to each of the first and second ends 211, 212, although the end caps 213 may be omitted. The panels 210 may have a U-shaped profile (and they may have U-shaped transverse cross-sectional areas). The panels 210 may be formed from metal, such as aluminum. More specifically, the panels 210 may be formed of a bent sheet metal having a particular thickness. That is, a sheet metal may be bent into a particular shape, for example the U-shape as shown, to form each of the panels 210. The particular length, width, and various length/width ratios of the panels 210 may be modified from that which is shown in various different embodiments.

The panels 210 may have a floor 214, first and second sidewalls 215 extending from opposing sides of the floor 214, and flanges 216 located at the distal ends of the sidewalls 215. The floor 214, the first and second sidewalls 215, and the flanges 216 may extend continuously along the full length of the panels 210. Alternatively, at least the flanges 216 may be discontinuous in their extension along the length of the panels 210. The flanges 216 may extend inwardly from the distal end of each of the sidewalls 215 towards one another or away from one another. The flanges 216 may comprise a plurality of apertures 217 arranged in a spaced apart manner along a length of the panel 210. The apertures 217 may be configured to receive a fastener for purposes of coupling the backslats 300 to the panels 210, as described in greater detail herein below. The exact shape and structure of the panels 210 are not to be limiting of the invention as set forth herein unless specified as such in the claims.

In the exemplified embodiment, the panel assembly 200 comprises three of the backslats 300, each of which is configured to be coupled to each of the three panels 210 of the panel assembly 200. However, the invention is not to be so limited in all embodiments and the panel assembly 200 may comprise two of the backslats 300 or more than three of the backslats 300 in other embodiments. For example, the middle backslat 300 could be omitted and the two backslats that are coupled to the panels 210 adjacent to the first and second ends 211, 212 of the panels 210 may be maintained, or additional backslats 300 may be added between the two backslats located adjacent to the first and second ends 211, 212 of the panels 210.

The backslats 300 are coupled to the panels 210 and may be arranged substantially parallel to one another. That is, each of the backslats 300 extends along a backslat axis B-B, and the backslat axis B-B of each of the backslats 300 is parallel to the backslat axis B-B of each of the other backslats 300. Because the backslats 300 span across each of the three panels 210 of the panel assembly 200 (in a widthwise direction), the backslats 300 when coupled to each of the panels 210 ensures that the panels 210 remain as part of the single unitary panel assembly 200 structure. The backslats 300 will be described in more detail below with reference to FIGS. 6-8.

The panel assembly 200 further comprises the plurality of mounting assemblies 400. In the exemplified embodiment, there are six of the mounting assemblies 400, although greater or fewer numbers of mounting assemblies 400 may be used in other embodiments. Each of the mounting assemblies 400 may comprise a mounting bracket 410 and a torsion spring 450 that is operably coupled to the mounting bracket 410. When assembled, the mounting brackets 410 are coupled to the backslats 300 and the torsion springs 450 are coupled to the mounting brackets 410. The torsion springs 450 may then engage the support grid 110 to couple the panel assemblies 200 to the support grid 100 and thereby form the ceiling system 100. In the exemplified embodiment, there are two (or a pair of) mounting assemblies 400 coupled to each of the backslats 300, although there could be fewer or greater than two mounting assemblies 400 for each backslat 300 in other embodiments depending on the amount of weight being supported, the length of the backslats 300, and other considerations. The mounting brackets 410 will be described in more detail below with reference to FIGS. 9-11 and the torsion springs will be described in more detail below with reference to FIG. 12.

Figure 6:
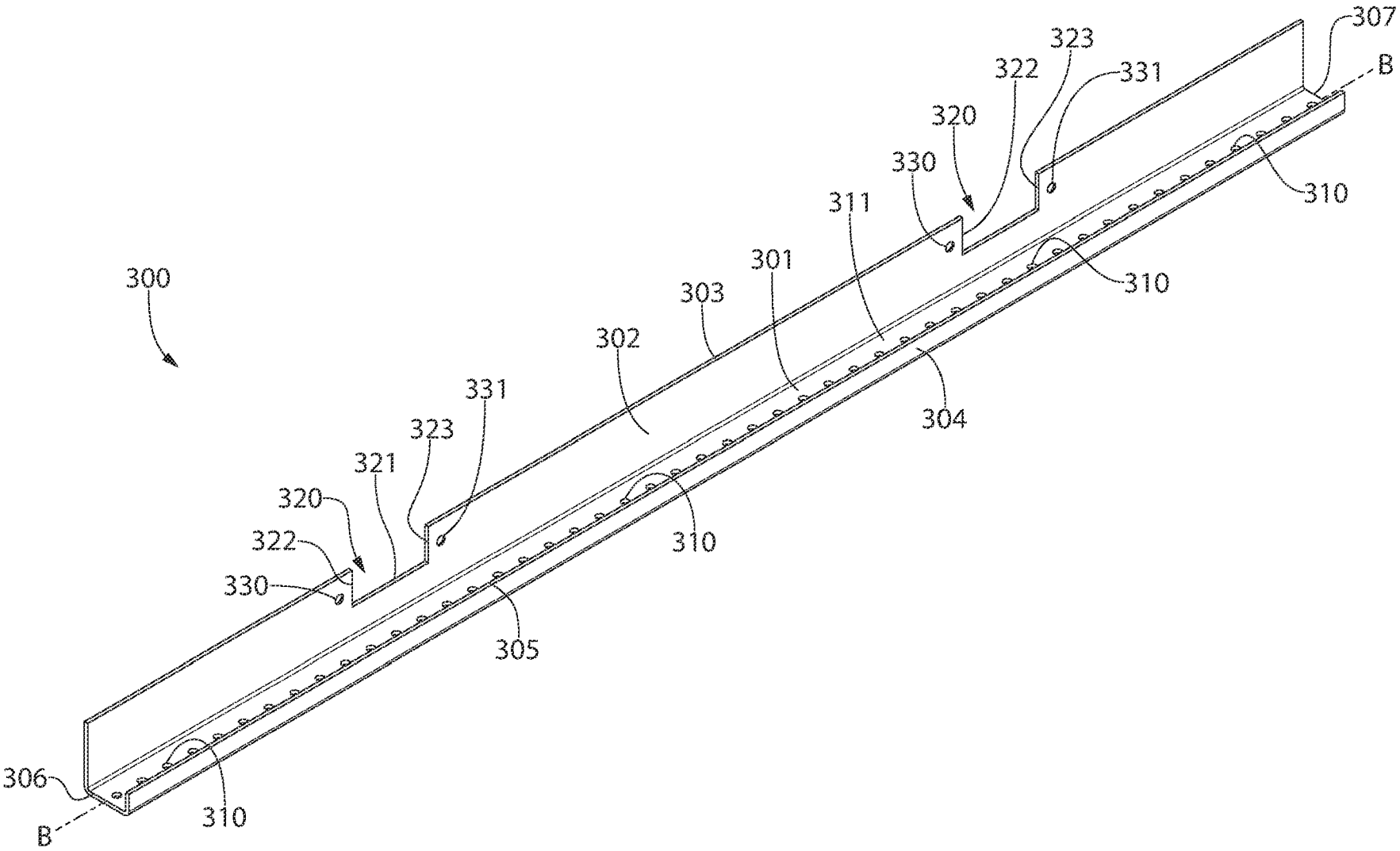
FIG. 6 is a perspective view of a backslat of the panel assembly of FIG. 4.
Figure 7:
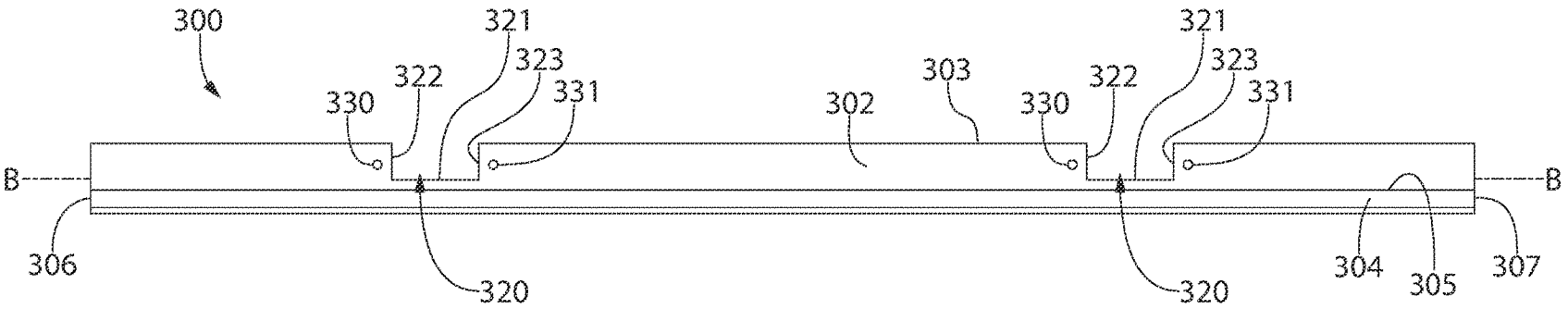
FIG. 7 is a front view of the backslat of FIG. 5.
Figure 8:
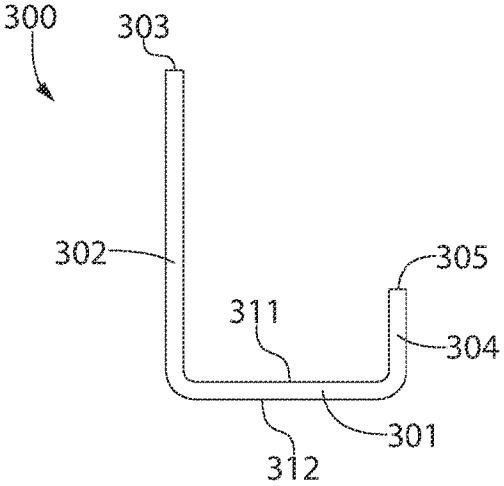
FIG. 8 is a side view of the backslat of FIG. 5.

Referring to FIGS. 6-8, the backslats 300 will be described. As discussed herein, the backslats 300 are configured to couple several of the panels 210 together, and to also support the mounting assemblies 400 for purposes of mounting the panel assemblies 200 to the support grid 110. The backslats 300 comprise a floor plate 301, a first wall plate 302 extending upwardly from the floor plate 301 to an upper edge 303, and a second wall plate 304 extending upwardly from the floor plate 301 to an upper edge 305. The first and second wall plates 302, 304 may be oriented parallel to one another and perpendicular to the floor plate 301, although this may not be required in all embodiments and the first and/or second wall plates 302, 304 may be oriented at a non-perpendicular angle relative to the floor plate 301 in an alternative embodiment. In the exemplified embodiment, the first wall plate 302 has a greater height measured from the floor plate 301 to the upper edge 303 than the second wall plate 304. Thus, the backslats 300 have a generally J-shape. However, the invention is not to be so limited in all embodiments and the backslats 300 may take on other shapes including being U-shaped, L-shaped (such as by omitting the second wall plate 304), or the like. The backslats 300 are elongated along the backslat axis B-B from a first end 306 of the backslat 300 to a second end 307 of the backslat 300.

Figure 13:
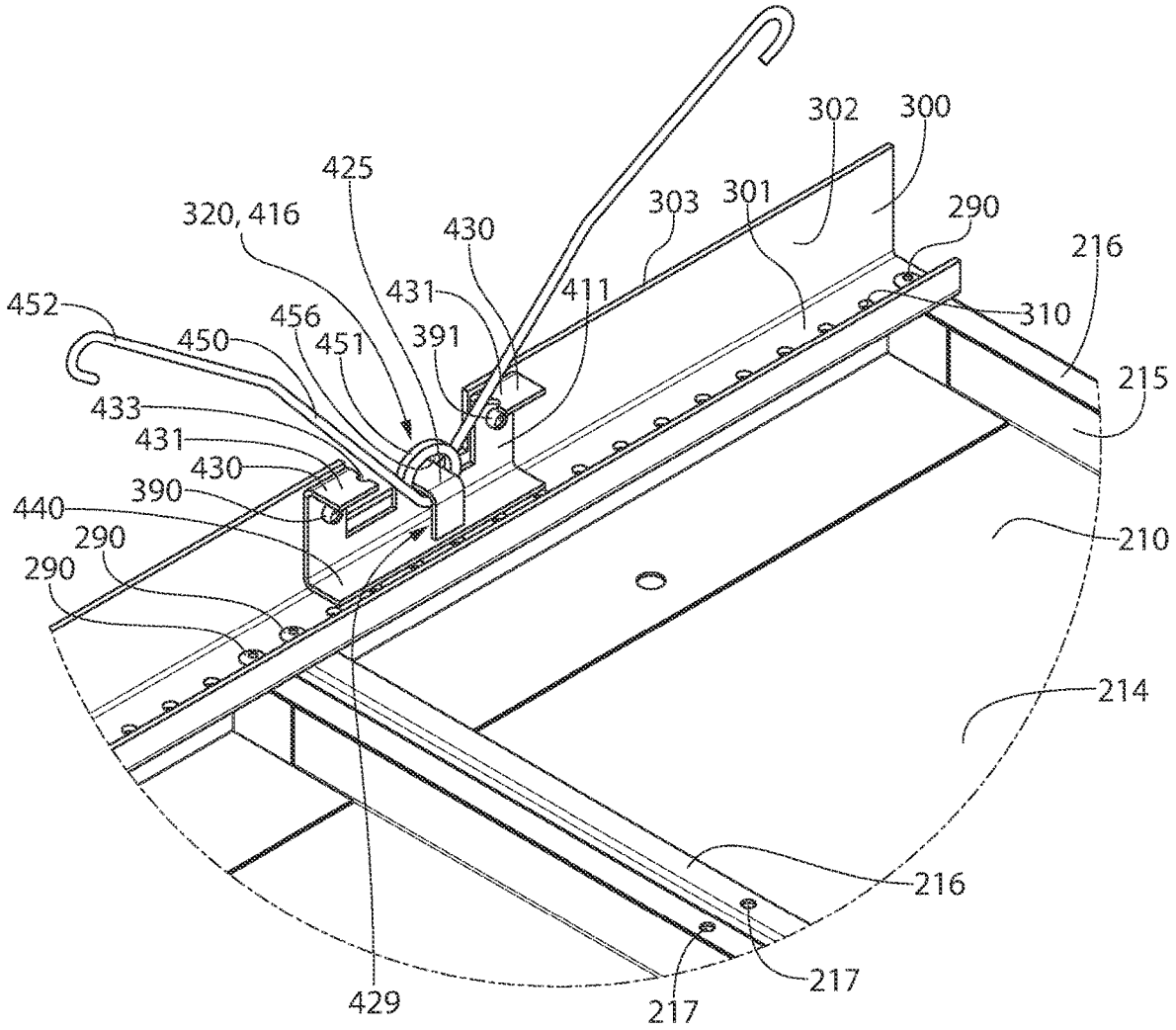
FIG. 13 is a close-up view of area XIII of FIG. 4.

The backslats 300 may comprise a series of pre-formed apertures 310 that are formed into and through the floor plates 301. Specifically, the floor plates 301 may comprise an upper surface 311 and a lower surface 312 opposite the upper surface 311. The first and second wall plates 302, 304 may extend upwardly from the upper surface 311. The series of pre-formed apertures 310 may be formed into the floor plates 301 so as to extend from the upper surface 311 to the lower surface 312. The pre-formed apertures 310 may be evenly spaced from one another along the full length of the backslats 300 from the first end 306 to the second end 307. That is, there may be equal spacing between all adjacent pre-formed apertures 310 of the series of per-formed apertures 310. Each of the apertures 310 may be equally spaced to the two apertures 310 that are adjacent to it (with the exception of the apertures 310 closest to the first and second ends 306, 307 because those apertures 310 are only adjacent to one other aperture 310). The backslats 300 may be coupled to the panels 210 by fasteners extending through selected ones of the pre-formed apertures 310 and into the apertures 217 in the flanges 216 of the panels 210. The fasteners may be rivets, which are best depicted in FIG. 13, although the invention is not to be so limited and the fasteners could alternatively be screws, studs, bolts, or the like. By having the pre-formed apertures 310 extend the full length of the backslats 300 in an evenly spaced manner, the backslats 300 may be used to coupled together various panels 210 of different width and even of different type (such as horizontal panels as shown or vertical panels, like shown in FIGS. 18 and 19). The series of apertures 310 allows for an easy and simple adjustment of the location along the backslat 300 to which the panels 210 are attached.

The backslats 300 further comprise a pair of notches 320 formed into the first wall plate 302. Although the exemplified embodiment depicts a pair (i.e., two) of the notches 320, the invention is not to be so limited in all embodiments and there could be a single notch 320 or more than two notches 320 in other embodiments. Each of the mounting brackets 410 is coupled to the backslat 300 at a location that is aligned with one of the notches 320, and thus the number of notches 320 may match the number of mounting brackets 410 used, although this is also not required in all embodiments and there may be a greater number of notches 320 than mounting brackets 410.

The pair of notches 320 are formed into the first wall plate 302 and extend from the upper edge 303 of the first wall plate 302 downwardly towards, but not all the way to, the upper surface 311 of the floor plate 301. That is, the pair of notches 320 terminate in a lower notch edge 321 that is recessed relative to the upper edge 303 of the first wall plate 302 and also spaced above the upper surface 311 of the floor plate 301. The notches 320 may have first and second side edges 322, 323 that extend from the lower notch edge 321 to the upper edge 303 of the first wall plate 302. The first and second side edges 322, 323 may be oriented perpendicular to the lower notch edge 321, although this is not required in all embodiments. The pair of notches 320 are positioned along the length of the first wall plate 302 of the backslats 300 in a spaced apart manner. In the exemplified embodiment, one of the notches of the pair of notches 320 is closer to the first end 306 of the backslats 300 and the other one of the notches of the pair of notches 320 is closer to the second and 307 of the backslats 300. Furthermore, the notches 320 are closer to the first and second ends 306, 307 of the backslats 300, respectively, than they are to one another. However, the spacing between the notches 320 is not to be limiting of the invention in all embodiments and the notches 320 may be closer to one another than to the respective one of the first and second ends 306, 307 to which they are closest in other embodiments. Moreover, there could be just one notch 320 that is centrally located along the length of the backslat 300 in other embodiments.

The first wall plate 302 of the backslats 300 may also comprise a first aperture 330 positioned adjacent to the first side edge 322 of each of the notches 320 and a second aperture 331 positioned adjacent to the second side edge 323 of each of the notches 320. The first and second apertures 330, 331 are configured to receive a fastener, such as a rivet, a bolt, a screw, or the like, to facilitate the coupling of the mounting brackets 410 of the mounting assemblies 400 to the backslats 300. Thus, each of the mounting brackets 410 of the mounting assemblies 400 is coupled to the first wall plate 302 of one of the backslats 300 at a position that is aligned with one of the notches 320.

Figure 9:
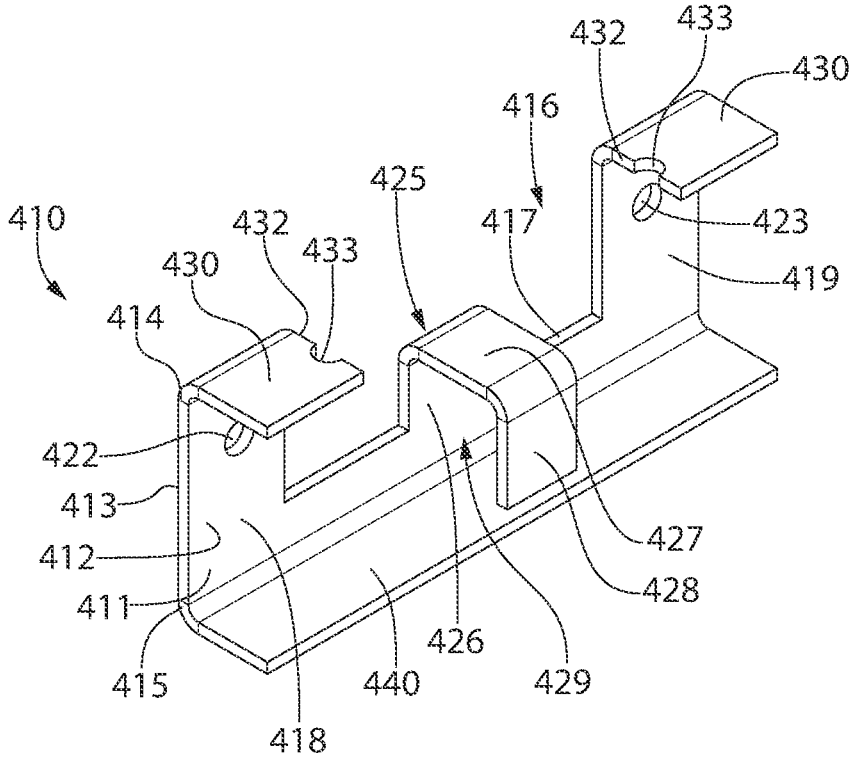
FIG. 9 is a perspective view of a mounting bracket of the panel assembly of FIG. 4.
Figure 10:
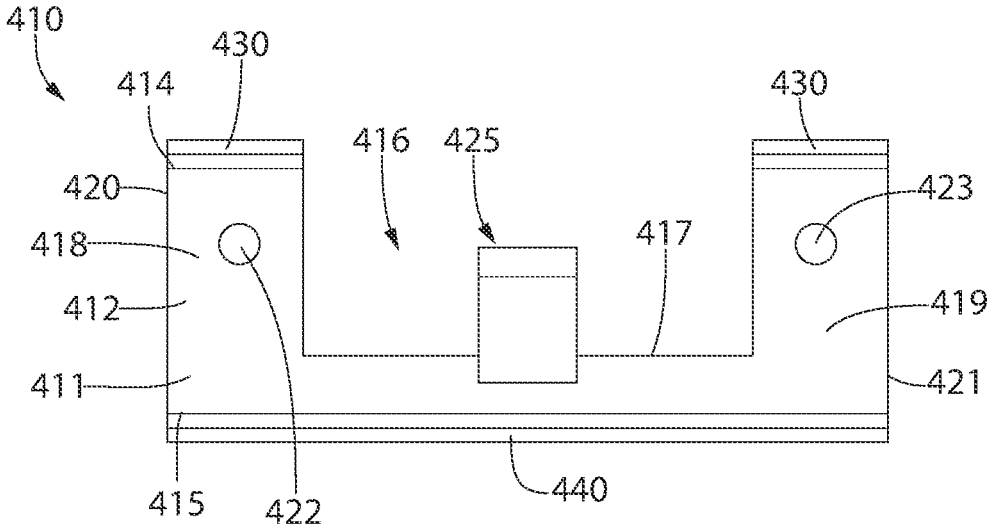
FIG. 10 is a front view of the mounting bracket of FIG. 8.
Figure 11:
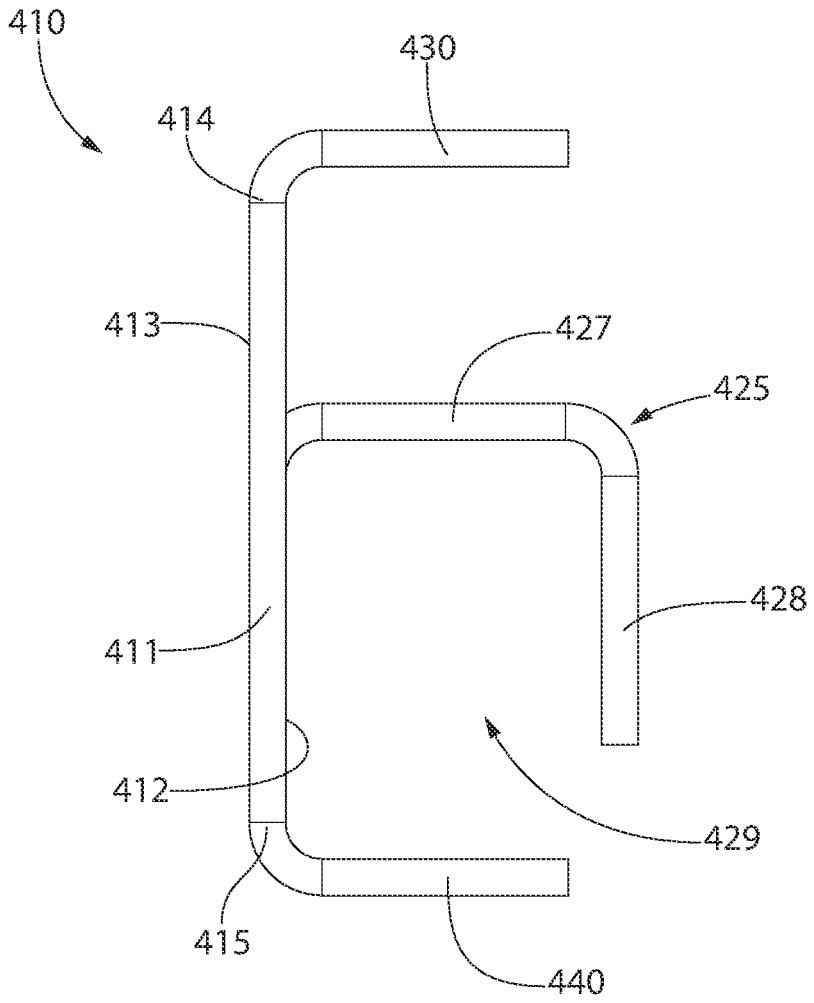
FIG. 11 is a side view of the mounting bracket of FIG. 8.

Referring to FIGS. 9-11, the mounting brackets 410 of the mounting assemblies 400 will be described. The mounting brackets 410 comprise a bracket wall plate 411 having a front surface 412, a rear surface 413, an upper edge 414, and a lower edge 415. When the mounting brackets 410 are coupled to the backslats 300, the bracket wall plate 411 is oriented vertically. The bracket wall plate 411 comprises a bracket notch 416 that is formed into the upper edge 414 and extends downwardly towards, but not to, the lower edge 415. The bracket notch 416 comprises a notch floor 417 that is recessed relative to the upper edge 414 and spaced upwardly relative to the lower edge 415.

The bracket notch 416 is located between a first section 418 of the bracket wall plate 411 and a second section 419 of the bracket wall plate 411. Stated another way, the first section 418 of the bracket wall plate 411 extends from the bracket notch 416 to a first side edge 420 of the bracket wall plate 411 and the second section 419 of the bracket wall plate 411 extends from the bracket notch 416 to a second side edge 421 of the bracket wall plate 411. The mounting bracket 410 comprises a first aperture 422 extending from the front surface 412 to the rear surface 413 along the first section 418 of the bracket wall plate 411 and a second aperture 423 extending from the front surface 412 to the rear surface 413 along the second section 419 of the bracket wall plate 411. The mounting brackets 410 are mounted to the backslats 300 by aligning the first and second apertures 422, 423 of the mounting brackets 410 with the first and second apertures 330, 331 in the first wall plate 302 of one of the backslats 300. This also places the bracket notch 416 of the mounting bracket 410 into alignment with the one of the notches 320 of one of the backslats 300. Then, a fastener such as a screw, rivet, bolt, or the like may be inserted through the first apertures 422, 330 and the second apertures 423, 331 to couple the mounting brackets 410 to the backslats 300. There may be one mounting bracket 410 coupled to each of the backslats 300 along each of the notches 320 of the backslats 300. Thus, if the backslats 300 each comprise two of the notches 320 as depicted, then there may be two of the mounting brackets 410 coupled to each of the backslats 300.

The mounting bracket 410 may further comprise a hook 425 that is aligned with the bracket notch 416. More specifically, the hook 425 may be located centrally along the width of the bracket notch 416, although this is not required in all embodiments. The hook 425 comprises a first vertical wall 426 extending vertically from the notch floor 417 of the bracket notch 416, a horizontal wall 427 extending perpendicularly from a distal end of the first vertical wall 426 in a direction away from the front surface 412 of the bracket wall plate 411, and a second vertical wall 428 extending downwardly from a distal end of the horizontal wall 427. A gap 429 exists between an inner surface of the second vertical wall 428 and a front surface of the first vertical wall 426. The hook 425 is configured to engage with one of the torsion springs 450 of the mounting assembly 400 as will be described in greater detail below.

The mounting bracket 410 may further comprise a pair of bracket tabs 430 extending from the bracket wall plate 411 at the upper edge 414 of the bracket wall plate 411. The bracket tabs 430 may extend in the same direction as the hook 425. The bracket tabs 430 may extend perpendicularly from the bracket wall plate 411. There may be a first bracket tab 430 extending from the first section 418 of the bracket wall plate 411 and a second bracket tab 430 extending from the second section 419 of the bracket wall plate 411, such that the first and second bracket tabs 430 are spaced apart by the bracket notch 416.

The bracket tabs 430 have inner edges 432 that face one another. That is, the inner edge 432 of the first bracket tab 430 extending from the first section 418 of the bracket wall plate 411 faces the inner edge 432 of the second bracket tab 430 extending from the second section 419 of the bracket wall plate 411. The bracket tabs 430 comprise a notch 433 located along the inner edge 432. The notch 433 may be arcuate or hemispherical in shape. The notches 433 may be configured to engage with arms of the torsion spring 450 such that the notches 433 provide a sort of pocket for a portion of the arms of the torsion spring 450 to nest within.

The mounting bracket 410 may further comprise a bracket floor plate 440 extending from the front surface 412 of the bracket wall plate 411 at the lower edge 415 of the bracket wall plate 411. The bracket floor plate 440 may extend from the bracket wall plate 411 in the same direction as the hook 425 and the bracket tabs 430. The bracket floor plate 440 may extend along the entire width of the bracket wall plate 411 from the first side edge 420 to the second side edge 421. This is possible because the lower edge 415 of the bracket wall plate 411 is not interrupted by the bracket notch 416 like the upper edge 414 of the bracket wall plate 411.

Figure 12:
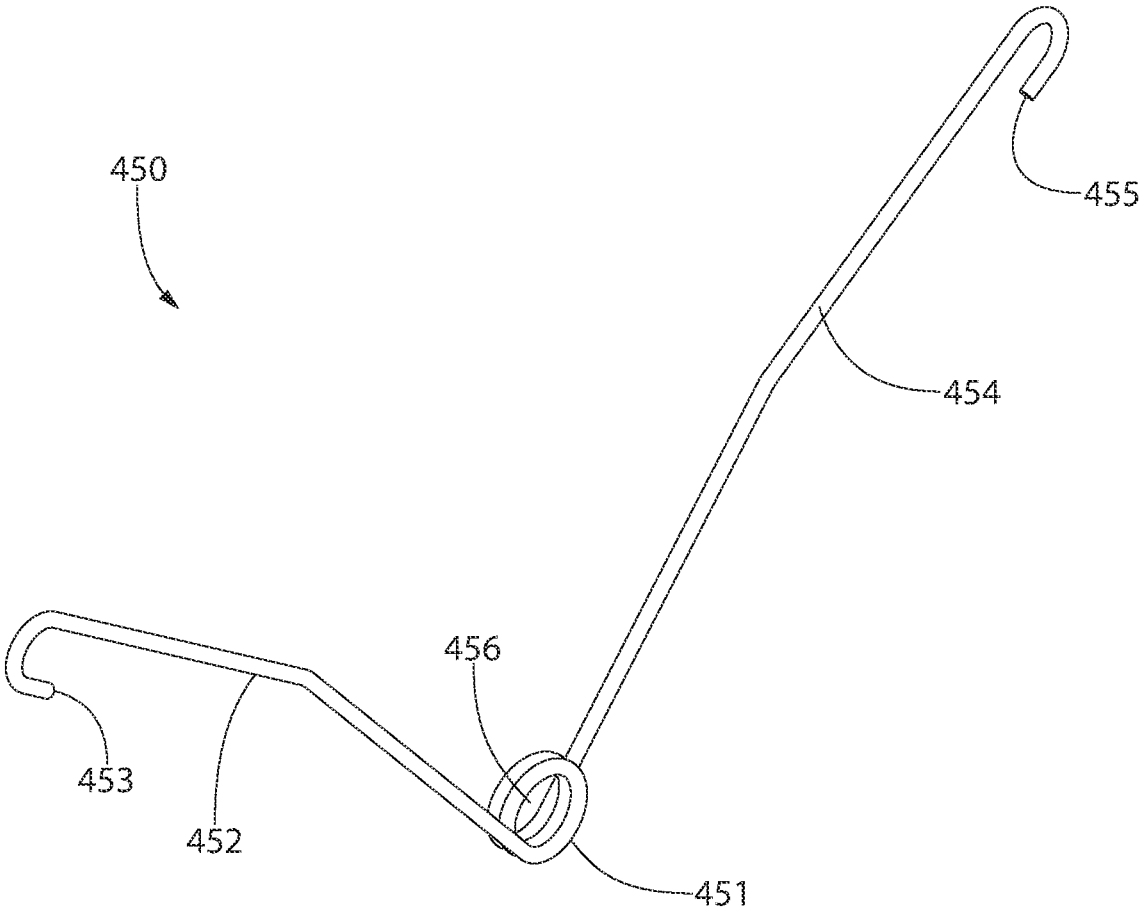
FIG. 12 is a perspective view of a torsion spring of the panel assembly of FIG. 4.

Referring to FIG. 12, the torsion spring 450 of the mounting assembly 400 is illustrated. There may be one torsion spring 450 for each one of the mounting brackets 410. Thus, in the exemplified embodiment each of the panel assemblies 200 may comprise six of the mounting brackets 410 and six of the torsion springs 450. Of course, more or fewer mounting brackets 410 and torsion springs 450 may be used in alternative embodiments, which may be dictated at least on part on the number of panels 210 and backslats 300 included in each of the panel assemblies 200.

The torsion spring 450 comprises a coil portion 451, a first arm 452 extending from the coil portion 451 to a distal end 453, and a second arm 454 extending from the coil portion 451 to a distal end 455. The coil portion 451 comprises an opening 456 that facilitates the attachment of the torsion spring 450 to the mounting bracket 410, as described in more detail below. Each of the first and second arms 452, 454 may terminate in a curled hook portion, although this is not required in all embodiments. The torsion spring 450 may be biased with the first and second arms 452, 454 being spread apart from one another. A user may squeeze the first and second arms 452, 454 to move the first and second arms 452, 454 closer together. Upon the user releasing any force applied onto the first and second arms 452, 454, the coil portion 451 will force the first and second arms 452, 454 to spread back apart from one another. Thus, a user may squeeze the first and second arms 452, 454 together during the mounting of the panel assembly 200 to the support grid 110 and may release the first and second arms 452, 454 to allow the first and second arms 452, 454 to lock (or couple/attach/mount) the panel assembly 200 to the support grid 110.

The backslats 300 may be formed from a first metal. Each of the mounting brackets 410 may be formed from a second metal. The second metal may be different than the first metal. For example, the first metal may be aluminum and the second metal may be steel. In one embodiment, the first metal may be 0.064 inch thick aluminum. The aluminum may be Series 3003-H14 aluminum sheet material. In one embodiment the second metal which is used to form the mounting brackets 410 may be 0.05 inch galvanized steel. The backslats 300 and the mounting brackets 410 may be formed from sheet metal which is bent to form the desired shape as depicted in the drawings and described herein.

The panels 210 may be formed from a bent third sheet metal having a third thickness. That is, the panels 210 may also be formed by bending a sheet metal without any welding or the like. In one embodiment, the panels 210 may be formed from 0.032 inch thick aluminum, such as 3003-H14 series aluminum sheets.

The first metal which is used to form the backslats 300 may have a first strength characteristic and the second metal which is used to form the mounting brackets 410 may have a second strength characteristic which is greater than the first strength characteristic. This may be useful to ensure that the mounting brackets 410, which directly support the weight of the panel assembly 200 via the torsion springs 450, is sufficiently strong to achieve this purpose. The first and second strength characteristics may be selected from the group consisting of yield strength, tensile strength, ultimate strength, compressive strength, impact strength, and shear strength. Thus, the material used to form the mounting brackets 410 may have a greater yield strength and/or tensile strength and/or ultimate strength and/or compressive strength and/or impact strength and/or shear strength as compared to the material used to form the backslats 300.

In another embodiment, the backslats 300 and the mounting brackets 410 may be formed from the same metal. In such an embodiment, the backslats 300 may be formed by a bent first sheet metal. Specifically, the backslats 300 may be formed by bending a first sheet metal material into the shape of the backslat 300, such as the J-shape depicted in FIG. 6-8. Thus, there may be no welding or the like in the formation of the backslats 300, but instead simply bending of a sheet metal. The mounting brackets 410 may be formed by a bent second sheet metal having a second thickness. Specifically, the mounting brackets 410 may be formed by bending a second sheet metal material into the shape of the mounting bracket 410 as depicted in FIGS. 9-11.

In such an embodiment, the first sheet material used to form the backslats 300 may have a first thickness while the second sheet material used to form the mounting brackets 410 may have a second thickness. The second thickness may be greater than the first thickness. In such an embodiment, the backslats 300 and the mounting brackets 410 may both be formed of the same material (both formed from aluminum or both formed from steel). Alternatively, in such an embodiment the backslats 300 and the mounting brackets 410 may be formed from different materials (the backslats 300 formed from aluminum and the mounting brackets 410 formed from steel). This may ensure that the mounting brackets 410, which directly support the weight of the panel assemblies 200, is sufficiently strong to achieve this function while keeping costs to a minimum by forming the backslats 300 out of a thinner material.

Thus, the mounting brackets 410 may either be formed from a different gauge/thickness of the same material as the backslats 300, or the mounting brackets 410 may be formed from a different, and stronger, material than the backslats. That is, both the mounting brackets 410 and the backslats 300 may be formed from sheet metal, either of the same material but of a different gauge, or of a different material. When the mounting brackets 410 and the backslats 300 are formed from a different material, they may still be formed from sheet metals having a different thickness or gauge Referring to FIG. 13, a close-up of the area denoted as XIII in FIG. 4 is provided to depict the engagement between the backslat 300 and the panels 210, between the mounting bracket 410 and the backslats 300, and between the torsion spring 450 and the mounting bracket 410. The panels 210 are aligned with the backslat 300 so that one of the apertures 217 in the first flange 216 of the panel 210 and one of the apertures 217 in the second flange 216 of the panel 210 are aligned with selected ones of the pre-formed apertures 310 in the backslat 300. As noted, the pre-formed apertures 310 in the backslat 300 are equi-spaced along the entire length of the backslat 300. As such, the panels 210 may have widths that are different from that which is depicted in FIG. 13, while still enabling the apertures 217 of the panel 210 to be aligned with selected ones of the pre-formed apertures 310 in the backslat 300.

Once the apertures 217 of the panel 210 are aligned with apertures 310 in the backslat 300, a fastener 290 may be inserted through the apertures 217 and the apertures 310 to effectively couple the backslat 300 to the panel 210. The apertures 217, 310 through which the fastener 290 extends are not visible in FIG. 13 due to the fastener 290 extending through those apertures 217, 310, but others of the apertures 217 and the apertures 310 are labeled in FIG. 13 for clarity of understanding. In the exemplified embodiment, the fastener 290 is a rivet. However, the invention is not to be so limited in all embodiments and the fastener 290 may take on other forms, including being a bolt, a screw, a stud, or the like. Additional backslats 300 may be aligned with additional sets of the apertures 217 in the panels 210 to provide additional support.

As seen in FIGS. 4 and 13 concurrently, the backslat 300 is coupled to multiple of the panels 210 at the same time. In particular, in the exemplified embodiment the backslat 300 is coupled to three of the panels 210. Furthermore, there are three of the backslats 300, and each of the backslats 300 is coupled to each of the three panels 210. The three backslats 300 include a backslat 300 adjacent to the first end 211 of the panels 210, a backslat 300 adjacent to the second end 212 of the panels 210, and a backslat 300 placed in between the first and second ends 211, 212 of the panels 210. The three panels 210 of the panel assembly 200 are positioned into alignment such that the first ends 211 of each of the three panels 210 are aligned and the second ends 212 of each of the three panels 210 are aligned. Two of the three backslats 300 may face in one direction and the other of the three backslats 300 may face in the opposite direction, as shown in FIG. 4. By attaching the backslats 300 to three of the panels 210, the panel assembly 200 is formed which then moves together as a unit. That is, the panel assembly 200 can be attached to and detached from the support grid 110 as a unit.

Referring again solely to FIG. 13, the mounting bracket 410 is mounted to the first wall plate 302 of the backslat 300. More particularly, the bracket notch 416 of the mounting bracket 410 is aligned with one of the backslat notches 320 of the backslat 300. In so aligning the bracket notch 416 with one of the backslat notches 320, the first and second apertures 422, 423 of the mounting bracket 410 are aligned with the first and second apertures 330, 331 in the first wall plate 302 of the backslat 300. A first fastener 390 may then be inserted through the first apertures 422, 330 and a second fastener 391 may then be inserted through the second apertures 423, 331 to couple the mounting bracket 410 to the backslat 300. The first and second fasteners 390, 391 may be screws, bolts, studs, rivets, or the like. The apertures 422, 423, 330, 331 are not visible in FIG. 13 due to the fasteners 390, 391 being positioned over and through them, but their existence should be well understood from the previous description. The mounting bracket 410 may be coupled to the backslat 300 before the backslat 300 is coupled to the panels 210 or after the backslat 300 is coupled to the panels 210.

When the mounting bracket 410 of the mounting assembly 400 is coupled to the backslat 300 as shown in FIG. 13, upper surfaces 431 of the tabs 430 of the mounting bracket 410 may be substantially flush with the upper edge 303 of the first wall plate 302 of the backslat 300. The term "substantially flush" as used herein may allow for a small tolerance of up to 1 mm in some embodiments. Furthermore, the bracket floor plate 440 may be elevated above the floor plate 301 of the backslat 300 (see FIG. 17), or the bracket floor plate 440 may be in contact with the floor plate 301 of the backslat 300. However, it may be preferable for the bracket floor plate 440 to be elevated above the floor plate 301 of the backslat 300 as depicted so that there is space for the fasteners 290 in the situation where the bracket floor plate 440 is aligned with one of the fasteners 290.

FIG. 13 further illustrates the engagement/coupling of the torsion spring 450 to the mounting bracket 410. In particular, the hook 425 of the mounting bracket 410 is inserted through the opening 456 in the coil portion 451 of the torsion spring 450. Thus, a portion of the coil portion 451 of the torsion spring 450 nests within the gap 429 of the hook 425. If a structure were to engage with the arms 452, 454 of the torsion spring 450, such engagement may enable the torsion spring 450 to support the remainder of the panel assembly 200 in a suspended manner Portions of the arms 452, 454 of the torsion spring 450 may nest within the notches 433 in the tabs 430 of the mounting bracket 410.

Because the mounting bracket 410 is either formed of a stronger material than the backslat 300 or formed of a material having a greater thickness than that of the backslat 300, the mounting bracket 410 is configured to support the weight of the panel assembly 200 when the panel assembly 200 is mounted to the support grid 110. That is, the hook 425 of the mounting bracket 410 is sufficiently strong such that it will not bend or deflect when the torsion spring 450 is engaged with the support grid 110. Rather, the hook 425 should be capable of maintaining its configuration despite supporting the full weight of the panel assembly 200 due to the material and thickness parameters described herein.

Figure 14:
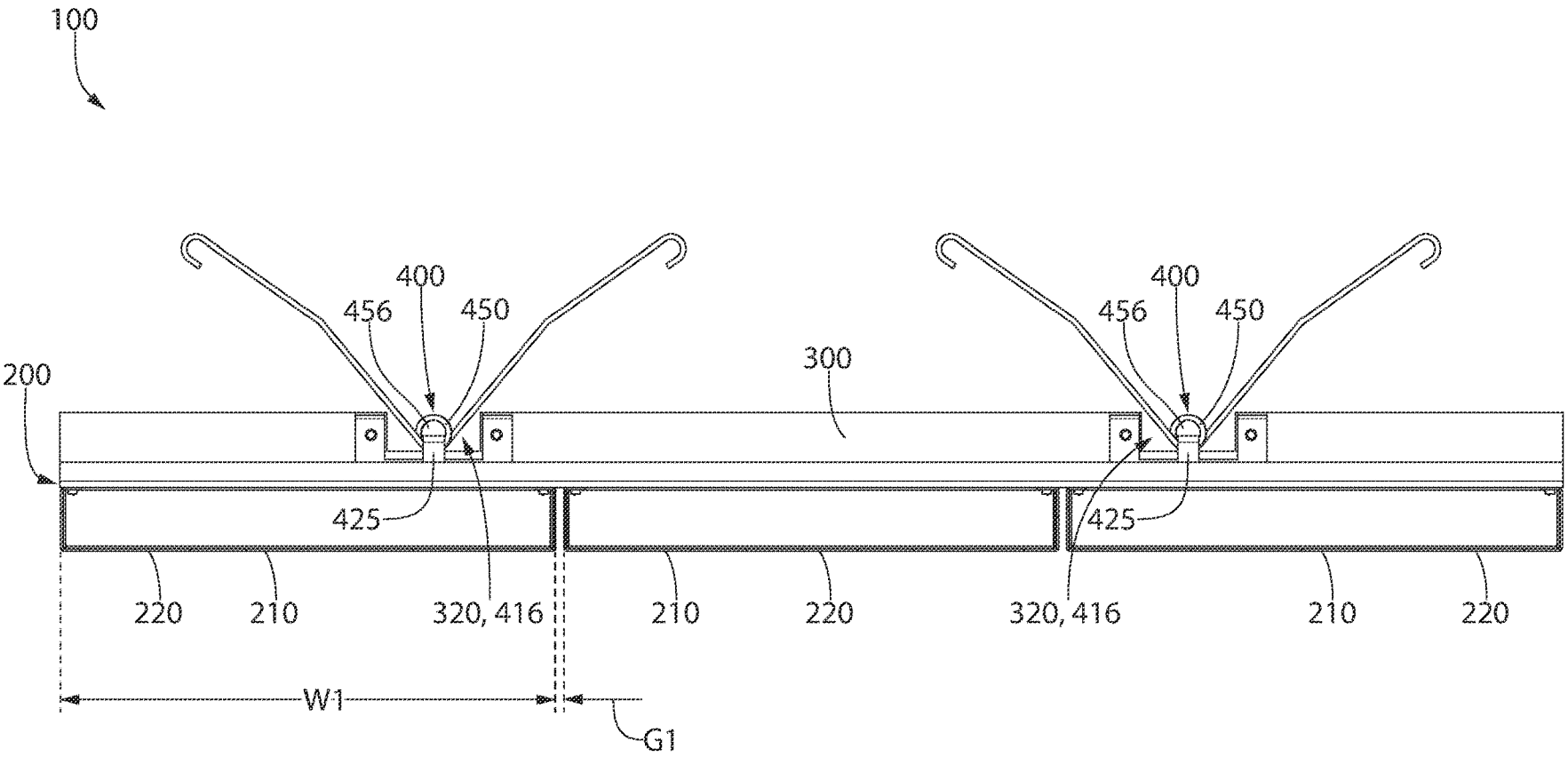
FIG. 14 is a cross-sectional view taken along line XIV-XIV of FIG. 4.

Referring to FIG. 14, the ceiling system 100 is illustrated from a cross-sectional view taken through the three panels 210 of the panel assembly 200 (FIG. 4 illustrates the location of the cross-section). The panels 210 each comprise a downwardly facing major surface 220 which is exposed to a person in a room in which the ceiling system 100 is located. The downwardly facing major surface 220 of the panels 210 defines a panel width W1. Furthermore, a gap G1 exists between laterally adjacent ones of the panels 210. The gap G1 may have a width that is much smaller than the panel width W1. The gap G1 may have a width that is less than one-half of the panel width W1, or less than one-fourth of the panel width W1, or less than one-tenth of the panel width W1 in some embodiments. The spacing distance between the adjacently positioned series of pre-formed apertures 310 of the backslats 300 in combination with the width of the flange 216 of the panels 210 (or the distance that the flanges 216 extend from the sidewalls 215) may define the width of the gap G1. In some embodiments, there may be no gap G1 and in other embodiments the gap G1 may be larger than shown in FIG. 14, which may be dictated by user preference, aesthetics, or the like.

Figure 15:
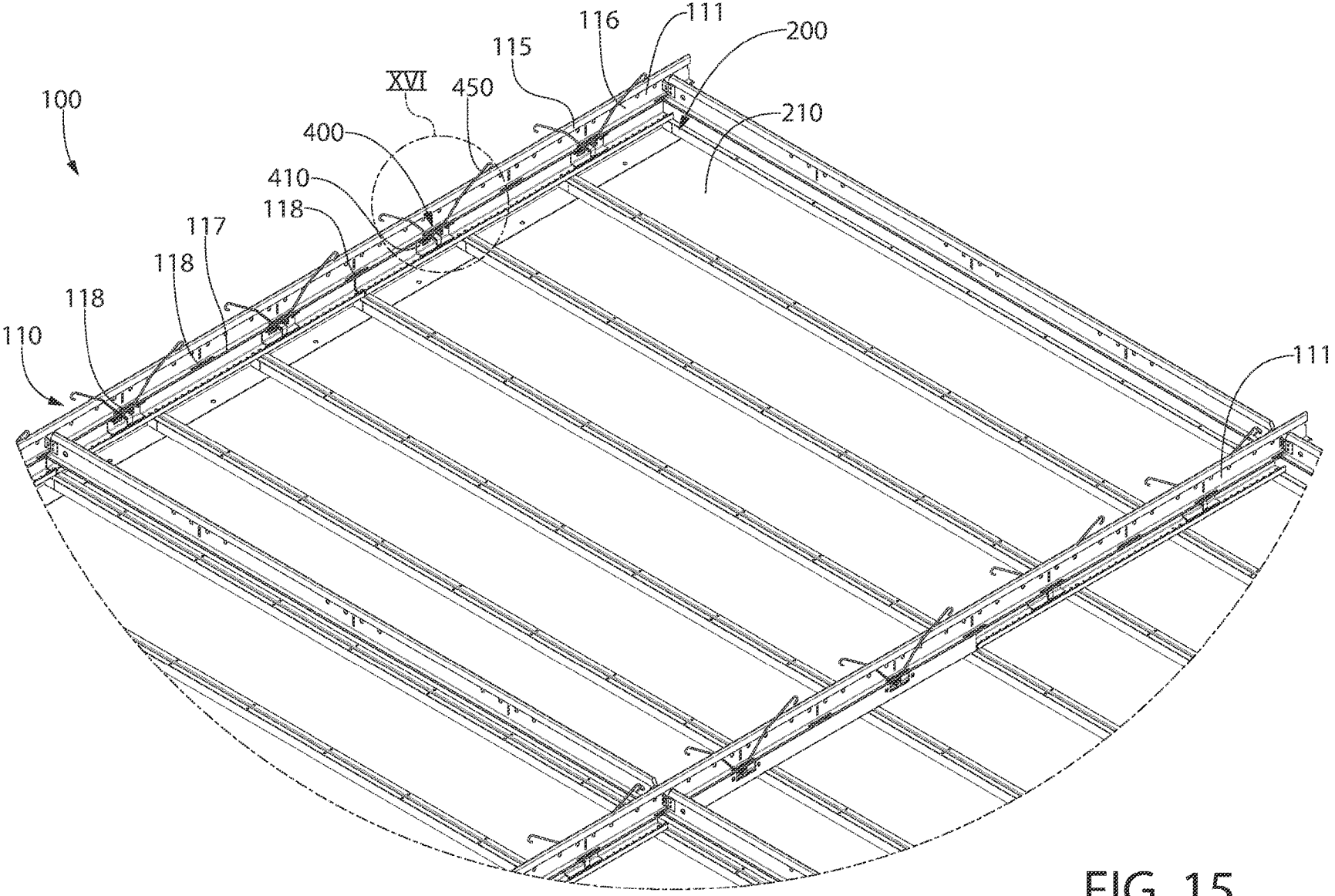
FIG. 15 is a close-up view of area XV of FIG. 2.
Figure 16:
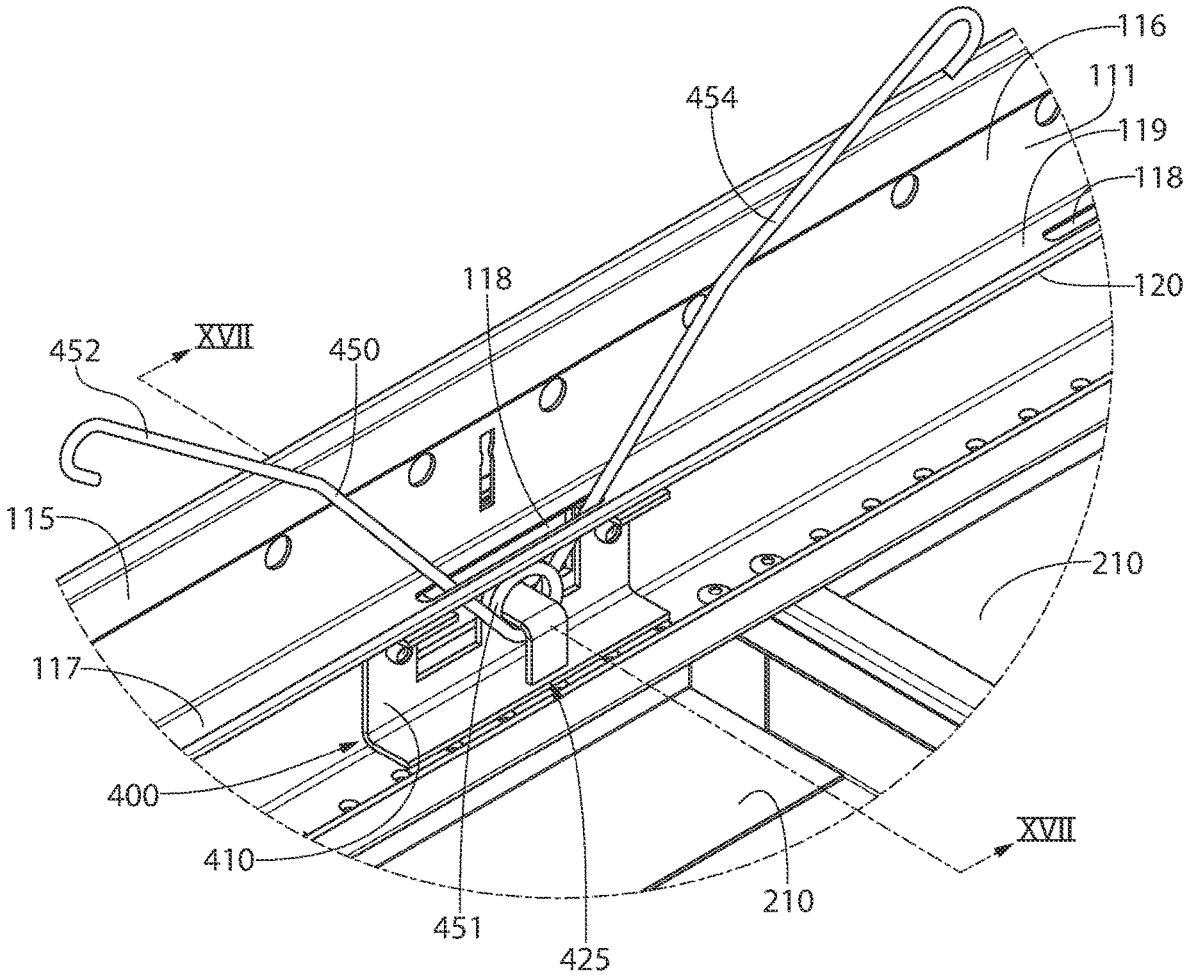
FIG. 16 is a close-up view of area XVI of FIG. 15.
Figure 17:
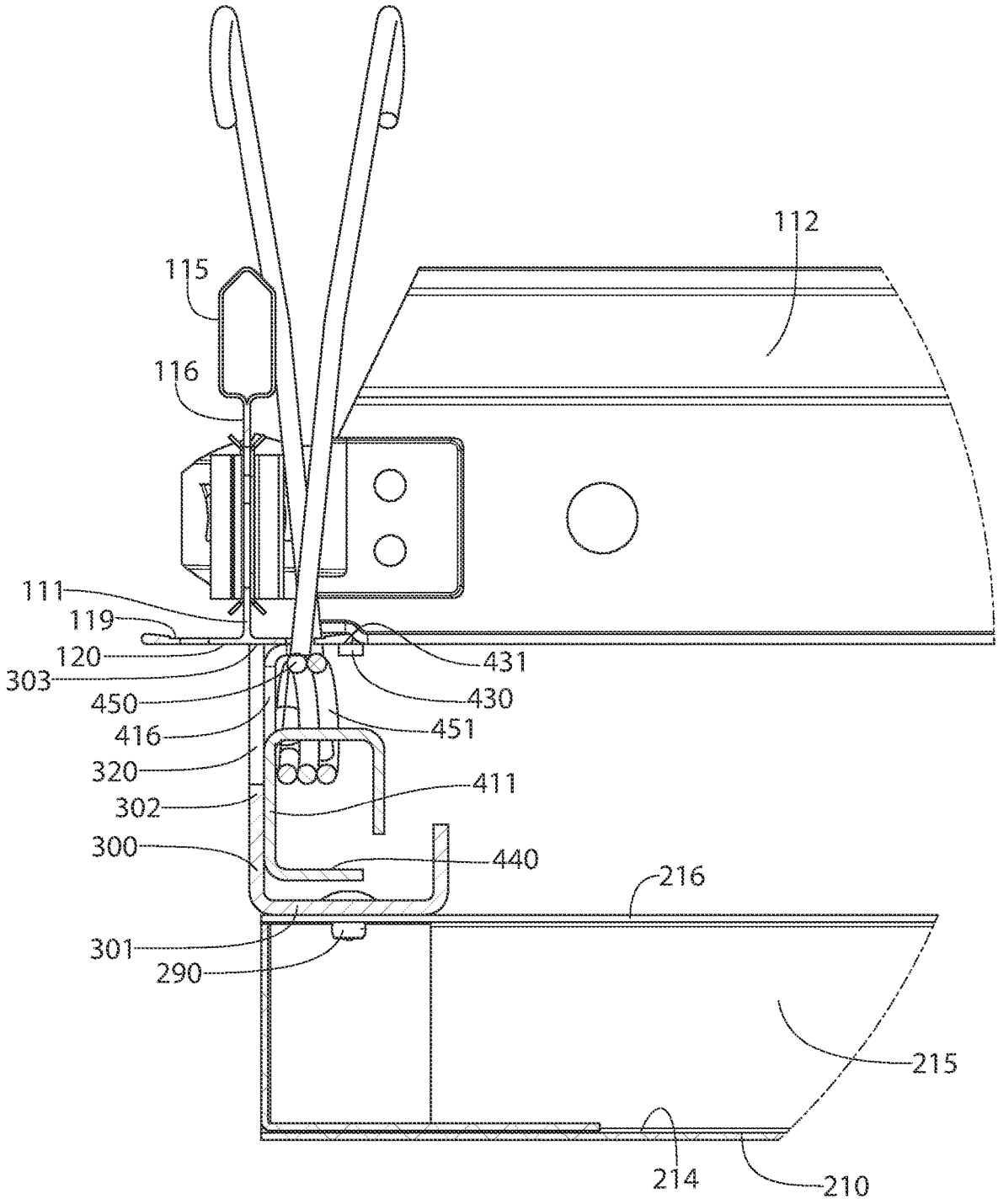
FIG. 17 is a cross-sectional view taken along line XVII-XVII of FIG. 16.

Referring to FIGS. 15-17, the mounting of the panel assembly (or panel assemblies) 200 to the support grid 110 will be described. As noted previously, the grid support 110 comprises the plurality of first grid beams 111 that are arranged substantially parallel to one another and the plurality of second grid beams 112 that are arranged substantially parallel to one another and substantially perpendicular to the first grid beams 111. Each of the first grid beams 111 may be an inverted T grid style beam that comprises a bulb portion 115, a web portion 116 extending downwardly from the bulb portion 115, and a flange portion 117 extending perpendicularly from the lower end of the web portion 116. The flange portion 117 may be oriented horizontally. Thus, the first grid beams 111 may form the shape of an upside-down "T."

The flange portion 117 may comprise a plurality of slots 118 arranged along the flange portion 117 in a spaced apart manner Each of the slots 118 may form an aperture that extends through the flange portion 117 from an upper surface 119 of the flange portion 117 to a lower surface 120 of the flange portion 117. The slots 118 may be elongated.

The panel assembly 200 may be mounted to the support grid 110 via engagement between the torsion springs 450 of the mounting assemblies 400 and one of the first grid beams 111 of the support grid 110. As shown in FIG. 15, each panel assembly 200 comprises four mounting assemblies 400 that are visible (there are two more which are not visible in FIG. 15, but are visible in FIG. 3, for example). Thus, at least one of the torsion springs 450 of one of the mounting assemblies 400 engages with a first one of the first grid beams 111 while another one of the torsion springs 450 of another one of the mounting assemblies 400 of the same panel assembly 200 engages with a second one of the first grid beams 111. This engagements between the torsion springs 450 and the first grid beams 111 mounts the panel assemblies 400 to the first grid beams 111.

In the exemplified embodiment, this mounting is achieved by squeezing the first and second arms 452, 454 of the torsion springs 450 together so that they are spaced apart by a maximum distance which is smaller than the width of the slots 118. The first and second arms 452, 454 of the torsion springs 450 may then be inserted through one of the slots 118 moving in a direction from the lower surface 120 of the flange portion 117 of the first grid beam 111 to the upper surface 119 of the flange portion 117 of the first grid beam 111. Once at least a portion of the first and second arms 452, 454 of the torsion springs 450 have passed through the slot 118, the first and second arms 452, 454 may be released so that they bias back outwardly into their natural state. This biasing of the first and second arms 452, 454 of the torsion spring 450 outwardly will cause the first and second arms 452, 454 to contact the ends of the slot 118 and pull the panel assembly 200 upwardly towards the lower surface 120 of the flange portion 117 of the first grid beam 111.

Once fully installed, and due to the biasing action of the torsion spring 450, the upper surfaces 431 of the tabs 430 of the mounting brackets 410 and the upper edge 303 of the first wall plate 302 of the backslat 300 may be biased into surface contact with the lower surface (or bottom surface) 120 of the flange portion 117 of the first grid beam 111. That is, as the torsion spring 450 biases back to its natural non-compressed state, it may pull the panel assembly 200 upwardly towards the first grid beam 111 until the aforementioned contact between the components occurs.

Figure 19:
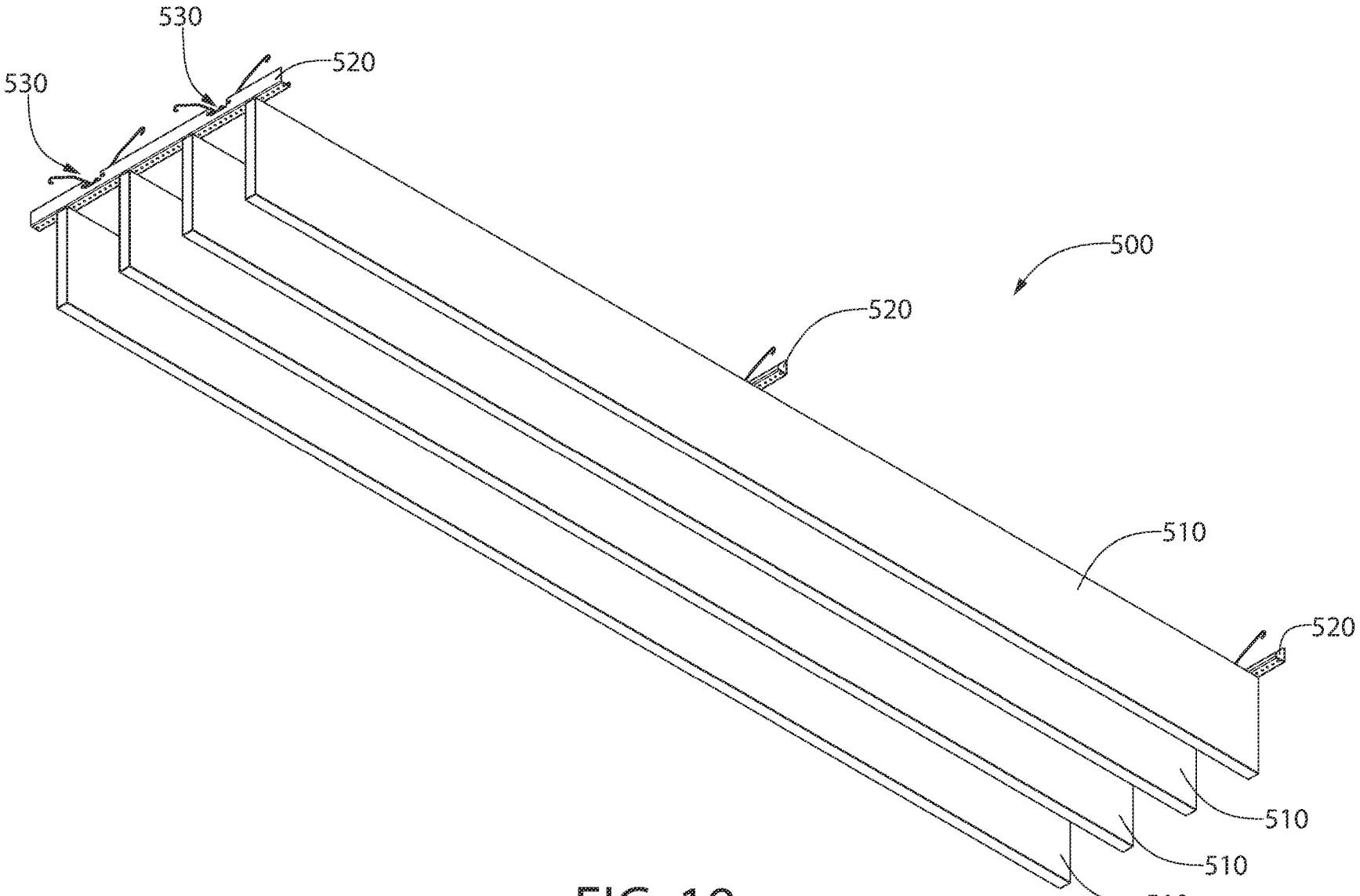
FIG. 19 is a bottom perspective view of the ceiling system of FIG. 18.

Referring to FIGS. 18 and 19, a panel assembly 500 of a ceiling system is illustrated in accordance with another embodiment of the present invention. The panel assembly 500 is configured to be mounted to the support grid 110 previously described in the same manner as discussed above. Thus, the previous discussion of the mounting of the panel assembly 200 to the support grid 100 is applicable to the panel assembly 500. However, the structure and/or some of the components of the panel assembly 500 are different than the panel assembly 200 as discussed below.

In this embodiment, the panel assembly 500 comprises a plurality of panels 510 (four are shown, but more or less are possible), a plurality of backslats 520 (three are shown, but more or less are possible), and a plurality of mounting assemblies 530 (six are shown, but more or less are possible). For purposes of the panel assembly 500, the backslats 520 and the mounting assemblies 530 may be identical to the backslats 300 and the mounting assemblies 400. Thus, the difference between the panel assembly 500 and the panel assembly 200 may relate only to differences between the panels 510 as compared to the panels 210. In particular, in this embodiment the panels 510 are configured to be hung vertically rather than horizontally. That is, the major surfaces of the panels 510 are intended to be oriented vertically when the panel assembly 500 is mounted to the grid support 110 rather than horizontally as with the panels 210 described above. Thus, in this embodiment the panels 510 may have apertures in their upper edge 511 for receiving fasteners that are used to couple the backslats 520 to the panels 510. The panels 510 may be referred to as vertical panels.

Assembly of the panel assembly 500 is the same as described above with reference to the panel assembly 200. Specifically, the backslats 520 are coupled to each of the panels 510 with fasteners, and the mounting brackets of the mounting assemblies 530 are coupled to the backslats 520 with fasteners. The panel assembly 500 is then configured to be mounted to the support grid 110 by squeezing the torsion springs of the mounting assemblies 530 and inserting the torsion springs through slots in the grid beams of the support grid 110.

Figure 20:
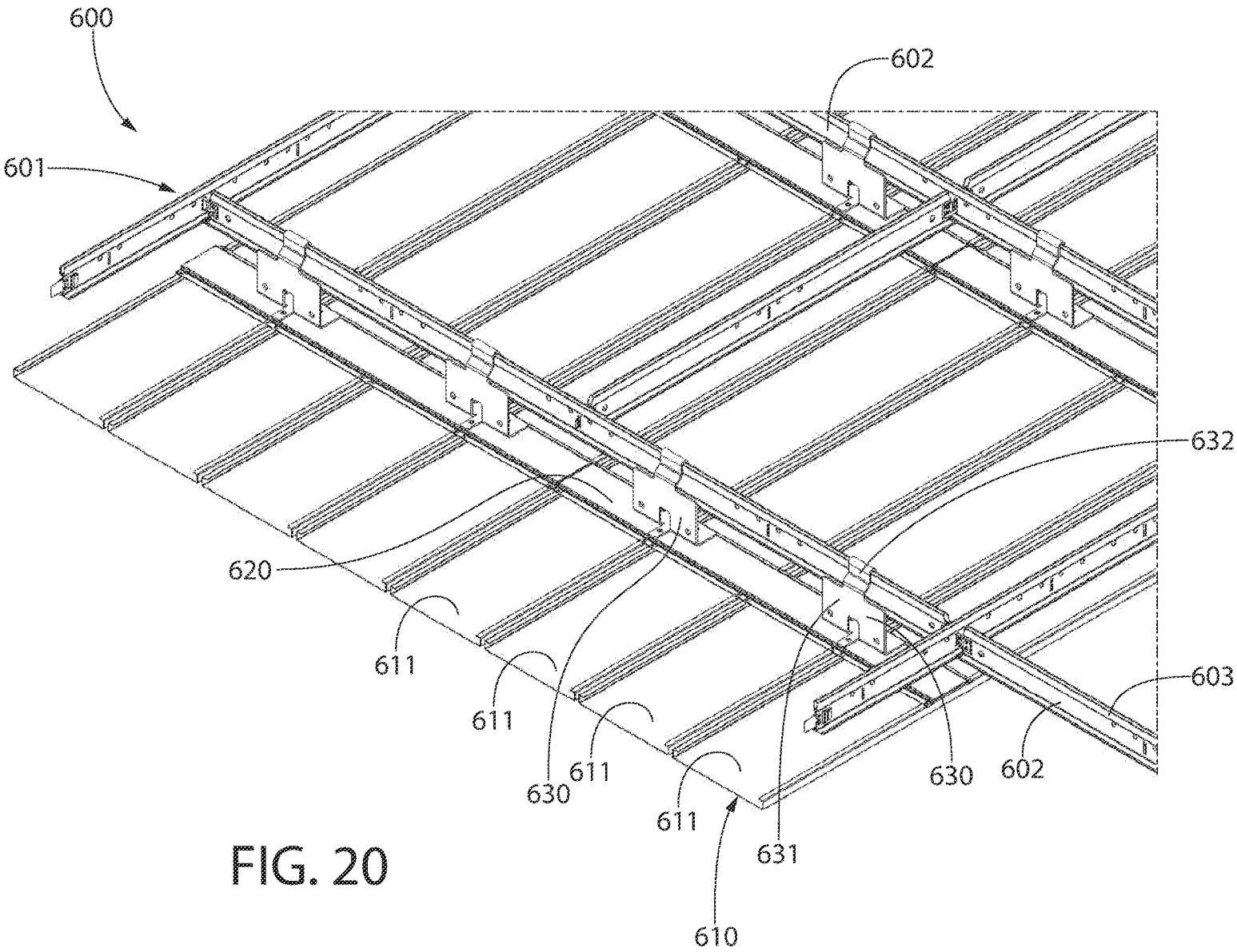
FIG. 20 is a partial top perspective view of a ceiling system in accordance with yet another embodiment of the present invention.

Referring to FIG. 20, yet another embodiment of a ceiling system 600 is illustrated. The ceiling system 600 comprises a support grid 601 comprising a plurality of first grid beams 602. The support grid 601 may be identical to the support grid 110 described above. The ceiling system 600 further comprises a plurality of panel assemblies 610 each comprising a plurality of panels 611, a plurality of backslats 620, and a plurality of mounting assemblies 630. The panels 611 may be identical to the panels 210 described above (i.e., horizontal panels) or identical to the panels 510 described above (i.e., vertical panels). In the exemplified embodiment, the panels 611 are horizontal panels.

The backslats 620 are configured to be coupled to each of the panels 611 of the particular panel assembly 610 to which the backslat 620 belongs. In the exemplified embodiment, there are four of the panels 611 in each panel assembly 610, and thus each backslat 620 is coupled to those four panels 611. More or less than four panels 611 may be included in each panel assembly 610 in other embodiments. The backslats 620 may be flat plates that are coupled to the panels 611 as shown in FIG. 20. Alternatively, the backslats 620 may take on the same structure as the backslats 300 described above.

The main difference between this embodiment and the embodiment described previously relates to the mounting assembly 630. In this embodiment, the mounting assembly 630 comprises a mounting bracket 631 that is coupled to the backslat 620. The mounting bracket 631 may be coupled to the backslat 620 with fasteners such as screws, rivets, studs, or the like. Alternatively, the mounting bracket 631 may form an integral part of the backslat 620. The mounting bracket 631 may comprise a hook portion 632 that is configured to engage with a bulb portion 603 of one of the first grid beams 602. That is, the hook portion 632 may be positioned over top of the bulb portion 603 of one of the first grid beams 602 and then lowered so that the hook portion 632 is in direct contact with the top of the bulb portion 603 of the one of the first grid beams 602 to which is it mounted. Thus, the main difference between this embodiment and the one previously described is that the torsion springs are omitted and the manner of mounting the panel assembly 610 to the support grid 601 is based on engagement between the hook portion 632 of the mounting bracket 631 and the bulb portion 603 of the first grid beams 602.

In one embodiment, the backslats 620 (or the backslats 300) may have integral features that are configured to engage with the first grid beam for mounting the panel assemblies to the support grid. Thus, the mounting assembly may be omitted or may be incorporated into the structure of the backslats 620 so that the backslats can be directly coupled to the various first grid beams of the support grid.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling system comprising:

a support grid comprising a plurality of first grid beams that are configured to be arranged substantially parallel to one another;

a panel assembly comprising:

first and second backslats that are configured to be arranged substantially parallel to one another, each of the first and second backslats extending along a backslat axis;

a plurality of panels configured to be arranged substantially parallel to one another, each of the panels extending along a panel axis from a first end to a second end, and each of the panels configured to be coupled to each of the first and second backslats;

a plurality of mounting assemblies, each of the mounting assemblies comprising a mounting bracket and a torsion spring configured to be operably coupled to the mounting bracket;

a first pair of the mounting assemblies configured to be coupled to the first backslat; and a second pair of the mounting assemblies configured to be coupled to the second backslat;

the panel assembly configured to be mounted to the support grid via the torsion springs of the first pair of the mounting assemblies engaging a first one of the first grid beams of the support grid and the torsion springs of the second pair of the mounting assemblies engaging a second one of the first grid beams of the support grid.

2. The ceiling system according to claim 1 further comprising:

each of the first and second backslats formed by a bent first sheet metal of a first thickness;

each of the mounting brackets formed by a bent second sheet metal of a second thickness; and wherein the second thickness is greater than the first thickness.

3. The ceiling system according to claim 1 further comprising:

each of the first and second backslats formed of a first metal;

each of the mounting brackets formed of a second metal that is different than the first metal; and wherein the first metal has a first strength characteristic and the second metal has a second strength characteristic that is greater than the first strength characteristic.

4. The ceiling system according to claim 3 wherein the first and second strength characteristics are selected from the group consisting of yield strength, tensile strength, ultimate strength, compressive strength, impact strength, and shear strength, wherein the first metal is an aluminum and the second material is a steel.

5. The ceiling system according to claim 3 further comprising:

each of the first and second backslats formed by a sheet of the first metal having a first thickness;

each of the mounting brackets formed by a sheet of the second metal having a second thickness; and the first thickness being greater than the second thickness.

6. The ceiling system according to claim 5 wherein each of the panels are formed of a bent third sheet metal of a third thickness that is less than the first thickness.

7. The ceiling system according to claim 1 wherein each of the first and second backslats comprises a floor plate and a first wall plate extending upward from the floor plate.

8. The ceiling system according to claim 7 further comprising:

the floor plates of the first and second backslats comprising a series of pre-formed apertures, the pre-formed apertures evenly spaced from one another and extending along an entire length of the first and second backslats; and each of the panels configured to be coupled to the first and second backslats by fasteners extending through selected ones of the pre-formed apertures.

9. The ceiling system according to claim 7, further comprising:

the first wall plate of the first backslat comprising a first pair of notches formed in an upper edge of the first wall plate of the first backslat;

the first wall plate of the second backslat comprising a second pair of notches in an upper edge of the second wall plate of the second backslat;

the mounting brackets of the first pair of the mounting assemblies coupled to the first wall plate of the first backslat in alignment with the first pair of notches; and the mounting brackets of the second pair of the mounting assemblies coupled to the first wall plate of the second backslat in alignment with the second pair of notches.

10. The ceiling system according to claim 9 further comprising:

for each of the mounting assemblies, the mounting bracket comprising:

a bracket wall plate comprising a bracket notch formed in an upper edge of the bracket wall plate, the bracket notch located between two sections of the bracket wall plate; and a hook aligned with the bracket notch, the hook inserted through a coil portion of the torsion spring;

the mounting brackets of the first pair of the mounting assemblies configured to be coupled to the first wall plate of the first backslat so that the bracket notches are aligned with the first pair of notches; and the mounting brackets of the second pair of the mounting assemblies configured to be coupled to the first wall plate of the second backslat so that the bracket notches are aligned with the second pair of notches.

11. The ceiling system according to claim 10 further comprising:

for each of the mounting assemblies, the mounting bracket comprising:

a pair of bracket tabs located at the upper edge of the bracket wall plate and extending outward from the two sections of the bracket wall plate; and a bracket floor plate located at a bottom edge of the bracket wall plate and extending outward from the wall plate in the same direction as the pair of bracket tabs;

the mounting brackets of the first pair of the mounting assemblies configured to be coupled to the first wall plate of the first backslat so that upper surfaces of the pair of bracket tabs are substantially flush with the upper edge of the first wall plate of the first backslat; and the mounting brackets of the second pair of the mounting assemblies configured to be coupled to the first wall plate of the second backslat so that upper surfaces of the pair of bracket tabs are substantially flush with the upper edge of the first wall plate of the second backslat.

12. The ceiling system according to claim 11 wherein the upper surfaces of the pair of bracket tabs of the mounting brackets of the first pair of the mounting assemblies and the upper edge of the first wall plate of the first backslat are configured to be biased into surface contact with a bottom surface of the first one of the first grid beams of the support grid by the torsion springs of the first pair of the mounting assemblies; and wherein the upper surfaces of the pair of bracket tabs of the mounting brackets of the second pair of the mounting assemblies and the upper edge of the first wall plate of the second backslat are configured to be biased into surface contact with a bottom surface of the second one of the first grid beams of the support grid by the torsion springs of the second pair of the mounting assemblies.

13. A ceiling system comprising:

a support grid comprising a plurality of first grid beams configured to be arranged substantially parallel to one another;

a panel assembly comprising:

first and second backslats configured to be arranged substantially parallel to one another, each of the first and second backslats extending along a backslat axis and comprising a floor plate comprising a series of pre-formed apertures, the pre-formed apertures evenly spaced from one another along a length of the first and second backslats; and a plurality of panels configured to be arranged substantially parallel to one another, each of the panels extending along a panel axis from a first end to a second end, and each of the panels configured to be coupled to each of the first and second backslats by fasteners extending through selected ones of the pre-formed apertures; an wherein the panel assembly is configured to be mounted to the support grid by coupling the first backslat to a first one of the first grid beams of the support grid and coupling the second backslat to a second one of the first grid beams of the support grid.

14. The ceiling system according to claim 13 wherein, for each of the first and second backslats, there is equal spacing between all adjacent pre-formed apertures of the series of pre-formed apertures.

15. The ceiling system according to claim 13 wherein, for each of the first and second backslats, the series of pre-formed apertures extends an entirety of the length of the first and second backslats.

16. The ceiling system according to claim 13 wherein each of the panels comprises a downwardly facing major surface defining a panel width; wherein a gap exists between laterally adjacent ones of the panels; and wherein the gap has a width that is less than the panel width, wherein the width of the gap is less than one-half the panel width.

17. A ceiling system comprising:

a support grid comprising a plurality of first grid beams configured to be arranged substantially parallel to one another;

a panel assembly comprising:

first and second backslats configured to be arranged substantially parallel to one another, each of the first and second backslats extending along a backslat axis;

a plurality of panels arranged configured to be substantially parallel to one another, each of the panels extending along a panel axis from a first end to a second end, and each of the panels coupled to each of the first and second backslats;

a plurality of mounting brackets configured to engage the first grid beams;

a first pair of the mounting brackets configured to be coupled to the first backslat; and a second pair of the mounting brackets configured to be coupled to the second backslat; and wherein the panel assembly is configured to be mounted to the support grid via the first pair of the mounting brackets engaging a first one of the first grid beams of the support grid and the second pair of the mounting brackets engaging a second one of the first grid beams of the support grid.

18. The ceiling system according to claim 17 further comprising:

each of the first and second backslats formed of a first metal;

each of the mounting brackets formed of a second metal that is different than the first metal; and wherein the first metal has a first strength characteristic and the second metal has a second strength characteristic that is greater than the first strength characteristic.

19. The ceiling system according to claim 18 wherein the first metal is an aluminum and the second material is a steel.

20. The ceiling system according to claim 18 further comprising:

each of the first and second backslats formed by a sheet of the first metal having a first thickness;

each of the mounting brackets formed by a sheet of the second metal having a second thickness; and the first thickness being greater than the second thickness.

* * * * *